US010856660B2

(12) United States Patent
Kinoshita et al.

(10) Patent No.: US 10,856,660 B2
(45) Date of Patent: Dec. 8, 2020

(54) CHAIR

(71) Applicants: KOKUYO CO., LTD., Osaka (JP); TAKANO CO., LTD., Nagano (JP)

(72) Inventors: Yojiro Kinoshita, Osaka (JP); Toshiki Yajima, Osaka (JP); Kenta Shiozawa, Kamiina-gun (JP); Tomoaki Ichikawa, Kamiina-gun (JP)

(73) Assignees: KOKUYO CO., LTD., Osaka (JP); TAKANO CO., LTD., Nagano (JP)

( * ) Notice: Subject to any disclaimer, the term of this patent is extended or adjusted under 35 U.S.C. 154(b) by 0 days.

(21) Appl. No.: 16/464,873

(22) PCT Filed: Dec. 20, 2016

(86) PCT No.: PCT/JP2016/088001
§ 371 (c)(1),
(2) Date: May 29, 2019

(87) PCT Pub. No.: WO2018/116384
PCT Pub. Date: Jun. 28, 2018

(65) Prior Publication Data

US 2019/0281985 A1 Sep. 19, 2019

(51) Int. Cl.
*A47C 3/025* (2006.01)
*A47C 3/026* (2006.01)
(Continued)

(52) U.S. Cl.
CPC ..... *A47C 3/026* (2013.01); *A47C 7/00* (2013.01); *A47C 7/14* (2013.01); *A47C 7/441* (2013.01)

(58) Field of Classification Search
CPC ..... A47C 3/26; A47C 7/441; A47C 3/026; A47C 7/00; A47C 7/14
(Continued)

(56) References Cited

U.S. PATENT DOCUMENTS 4,555,085 A * 11/1985 Bauer ..... A47C 3/026 248/371
4,575,151 A * 3/1986 Edstrom ..... A47C 3/026 297/302.6
(Continued)

FOREIGN PATENT DOCUMENTS

CA 3044190 A1 * 6/2018 ..... A47C 3/026
DE 102010016989 A1 11/2011
(Continued)

OTHER PUBLICATIONS

International Search Report dated Apr. 4, 2017, issued in counterpart International Application No. PCT/JP2016/088001 (2 pages).
(Continued)

*Primary Examiner* — Rodney B White
(74) *Attorney, Agent, or Firm* — Westerman, Hattori, Daniels & Adrian, LLP

(57) ABSTRACT

A chair according to the present invention is a chair comprising a leg 1 arranged on a floor surface, a leg support pole 13 erected from the leg 1, a support base 4 fixed at an upper end of the leg support pole 13, a seat 2 arranged above the support base 4 and a support mechanism 5 interposed between the support base 4 and the seat 2 and configured to support the seat 2 movably in a front-rear direction and a left-right direction. Additionally, in the support mechanism 5, a left-right support part 51 is attached to the support base 4 movably in a left-right direction, a front-rear part 52 is attached to the left-right support part 51 movably in a front-rear direction, the seat 2 is attached to the front-rear support part 51, and the support base 4 has an arm attachment part 6.

11 Claims, 20 Drawing Sheets

(51) Int. Cl.
*A47C 7/44* (2006.01)
*A47C 7/00* (2006.01)
*A47C 7/14* (2006.01)

(58) Field of Classification Search
USPC ..... 297/314
See application file for complete search history.

(56) References Cited

U.S. PATENT DOCUMENTS

| | | | | |
|---|---|---|---|---|
| 4,664,352 | A * | 5/1987 | Shibuki | B60N 2/502 188/266.7 |
| 5,035,466 | A * | 7/1991 | Mathews | A47C 1/023 297/337 |
| 5,951,109 | A * | 9/1999 | Roslund, Jr. | A47C 1/03255 297/299 |
| 6,523,897 | B2 * | 2/2003 | Pan | A47C 1/022 297/300.2 |
| 6,685,268 | B2 * | 2/2004 | Meyer | A47C 7/448 297/314 X |
| 6,688,689 | B1 * | 2/2004 | Thorn | A47C 3/0252 297/314 X |
| 6,979,059 | B1 * | 12/2005 | Conlin | A47C 3/026 297/314 X |
| 7,100,983 | B1 * | 9/2006 | Gant | A47C 3/025 297/314 X |
| 8,029,060 | B2 * | 10/2011 | Parker | A47C 1/023 297/314 X |
| 8,182,036 | B2 | 5/2012 | Nishino | |
| 8,439,442 | B2 * | 5/2013 | Highlander | A47C 7/14 297/314 X |
| 8,857,909 | B2 * | 10/2014 | Bock | A47C 3/026 297/302.2 |
| 10,058,180 | B2 * | 8/2018 | Desanta | A47C 7/448 |
| 2003/0015900 | A1 | 1/2003 | Lu | |
| 2007/0040433 | A1 * | 2/2007 | Huang | A47C 1/03238 297/325 |
| 2009/0278388 | A1 * | 11/2009 | Reingewirtz | A47C 3/025 297/314 X |
| 2011/0089733 | A1 | 4/2011 | Nishino | |
| 2012/0256458 | A1 * | 10/2012 | Gehner | A47C 7/443 297/314 |
| 2018/0279785 | A1 * | 10/2018 | Moreschi | A47C 1/03272 |
| 2019/0045928 | A1 * | 2/2019 | Yajima | A47C 1/024 |
| 2019/0208910 | A1 * | 7/2019 | Sugano | A47C 3/18 |
| 2019/0343286 | A1 * | 11/2019 | Sugano | A47C 3/027 |

FOREIGN PATENT DOCUMENTS

| | | | | |
|---|---|---|---|---|
| DE | 202012006249 | U1 | 10/2013 | |
| EP | 2387913 | A1 | 11/2011 | |
| EP | 2862482 | B1 * | 5/2016 | A47C 3/22 |
| JP | 2004-8440 | A | 1/2004 | |
| JP | 3144593 | U | 9/2008 | |
| JP | 2009-233241 | A | 10/2009 | |
| JP | 2010-29646 | A | 2/2010 | |
| JP | 2011-167342 | A | 9/2011 | |
| JP | 2012-10938 | A | 1/2012 | |
| JP | 5190608 | B2 | 4/2013 | |
| JP | 5789753 | B2 | 10/2015 | |
| WO | 89/04623 | A1 | 6/1989 | |
| WO | 2007/010618 | A1 | 1/2007 | |

OTHER PUBLICATIONS

Office Action dated Apr. 7, 2020, issued in counterpart JP Application No. 2018-557275, with English Translation. (10 pages).
Extended (Supplementary) European Search Report dated Oct. 2, 2020, issued in counterpart EP Application No. 16924493.6. (8 pages).

* cited by examiner

CHAIR

TECHNICAL FIELD

The present invention relates to a chair appropriately applicable for office use or the like.

BACKGROUND ART

Many chairs such as swivel chairs for office use, which are intended for a sitting person to maintain a comfortable sitting posture for a long time in an office, at home, or the like have been conventionally proposed (for example, see Patent Document 1).

Each of the swivel chairs for office use is configured to be able to incline a seat or a backrest in accordance with mainly backward or forward tilting of a sitting person such that the sitting person can comfortably act while doing work or to be able to fix the seat and the backrest at the position that allows a required posture of the sitting person to be realized.

In the meantime, it is observed from the outside that a sitting person sitting on the swivel chair for office use for a long time usually holds the posture in which the sitting person feels comfortable. However, practically, it becomes clear that the comfortable sitting posture is maintained with the swivel chairs for office use by moving constantly a lumbar region, a gluteal region and a femoral region from the required posture.

Therefore, it can be said that it is required for the present chair to have a function that can appropriately support the behavior of the sitting person as described above. As a chair close to such a concept, the chair having the arm as described in Patent Document 2 can be cited.

CITATION LIST

Patent Literature

Patent Document 1: Japanese Unexamined Patent Application Publication No. 2012-010938

Patent Document 2: Utility Model Registration No. 3144593

SUMMARY OF THE INVENTION

Problem to be Solved by the Invention

Here, in the chair according to above-mentioned Patent Document 2, a seat configured to be able to operate in a front-rear direction and a left-right direction at the same time above a leg is provided and an arm is separately fixed to the leg. Further, the arm is fixed by a support base which spreads outward beyond the operation range of a support mechanism supporting the seat in plan view at the base end and extends upward therefrom.

With the above-mentioned configuration, the support base is enlarged in relation to the support mechanism and the attaching condition of the arm to the support base is determined by the size or shape of the support base as secondary. Therefore, when taking an arm extending direction or strength into consideration, the trouble is also caused that the arm is easily formed to widely overhang in front view beyond the circumventing extent in which an interference with the seat is not allowed and inevitably increases too much in size.

The present invention is intended to solve the above problems, and also to provide a chair that allows a sitting person to obtain a comfortable sitting feeling and that can stably maintain a high operation efficiency with a compact configuration.

Means for Solving the Problem

The following means are taken in the present invention to achieve the object.

Therefore, the chair according to the present invention includes a leg arranged on a floor surface, a leg support pole erected from the leg, a support base provided at an upper end of the leg support pole, a seat arranged above the support base, and a support mechanism interposed between the support base and the seat and configured to support the seat movably in a front-rear direction and a left-right direction. The support mechanism includes a left-right support part and a front-rear support part, and one of the left-right support part and the front-rear support part is attached to the support base and the seat is attached to the other of the left-right support part and the front-rear support part. The support base has an arm attachment part.

With the configuration, even when the support mechanism of the seat is combined with the front-rear support part and the left-right support part in a superimposed manner, the support base increases in flexibility of the design and thus, the support base can be easily attached so as not to interfere with the front-rear support part and the left-right support part. Therefore, it is easily designed to form so that an arm does not circumvent widely to an extreme degree beyond the extent in which an interference with the seat is avoided and an appropriate strength is secured. That is, when the arm is configure so as not to move in the front-rear and left-right directions and a sitting person sits the chair that is intentionally decreased in stability, the sitting person can be supported and then, can obtain a sense of safety.

In addition, in order to achieve both an easy attachment of the arm and a sitting feeling of the sitting person, it is desirable that the one of the left-right support part and the front-rear support part is the left-right support part and that the other of the left-right support part and the front-rear support part is the front-rear support part.

In order to effectively realize a secure of an appropriate extending condition of the arm attachment part and an appropriate attaching position of the seat while spatially efficiency arranging the above-described support member, a left-right support portion and a front-rear support portion, it is desirable that the support base is attached above the leg support pole, a left-right support portion which configures the left-right support part is arranged from the support base through a pair of right and left support members, the front-rear support portion which configures the front-rear support part is arranged at the left-right support portion through a pair of front and rear support members, and the seat is attached to the front-rear-support portion.

In order to specifically realize an efficient spatial arrangement for arranging the seat and the arm attachment part, it is desirable that the support base is attached to the leg support pole, the left-right support portion is arranged below the arm attachment part, the front-rear support portion is arranged above the arm attachment part, and the seat is attached to the front-rear support portion.

In order to appropriately secure a space in which the arm attachment part is extended, it is desirable that the arm attachment part extends both laterally from the support base through the space between the left-right support portion and the front-rear support portion.

In order to appropriately secure an attaching position of the arm, it is desirable that the arm attachment part is provided with projecting outward beyond the left-right support part and the front-rear support part at the both side ends of the support base.

In addition, in order to simplify an attaching operation of the arm and to easily allow an option as a retrofitting structure, it is desirable that the arm is provided detachably at the arm attachment part.

In order to improve an appearance of the vicinity of the extending position of the arm attachment part without an interference with movement of the seat, it is desirable that the chair comprises a cover member that covers the support mechanism while operating following the movement of the seat and that the cover member is provided below the seat and arranged so as not to interfere with the arm attachment part and the arm.

In addition, when the left-right support part or the front-rear support part has a link member that suspends and supports a member to be supported from the support member, it can be easily secure the space in up-and down direction for extending the arm attachment part within the suspension distance of the link member.

In order to prevent a space in an up-down direction for extending the arm attachment part from narrowing as much as possible, it is desirable that the left-right support part or the front-rear support part has a cam surface disposed at either a support member or a member to be supported, and a cam follower that is disposed at the other of the support member or the member to be supported and that slides along the cam surface. That is, with the cam structure as described above, a movement in a horizontal direction is mainly performed and thus, it is possible to prevent the space in the up-down direction for extending the arm attachment part from narrowing as much as possible.

When the support base is provided rotatably horizontally to the leg and the chair is a swivel chair, it is possible to effectively realize a front-rear and left-right swinging movement of the chair with the arm.

In order to allow a lifting up and down lever to be appropriately extended from the support base together with the arm attachment part, it is desirable to configure so that the leg support pole includes a lifting up and down mechanism configured to support the support base vertically movably, the lifting up and down mechanism includes a the lifting up and down mechanism body that performs an expansion and contraction operation and a lifting up and down lever for controlling the expansion and contraction operation, and the lifting up and down lever is arranged at the lower surface side of the arm attachment part.

In addition, the arm attachment part may be provided at the front-rear support part. A sitting person can hold on with his/her feet in a front direction and is supported by a backrest in a rear direction and thus, the sitting person does not fall in these directions. When the arm moves only to the front-rear direction, the sitting person does not feel a sense of anxiety. That is, it is also acceptable that the one of the left-right support part and the front-rear support part is the front-rear support part and that the other of the left-right support part and the front-rear support part is the left-right support part.

Effect of the Invention

The present invention described above provides the chair that allows a sitting person to obtain a comfortable sitting feeling and that can stably maintain a work efficiency by increasing in a flexibility of design of the arm attachment part.

MODE FOR CARRYING OUT THE INVENTION

First Embodiment

Herein, a first embodiment of the present invention will be described with reference to the drawings.

Figure 1:
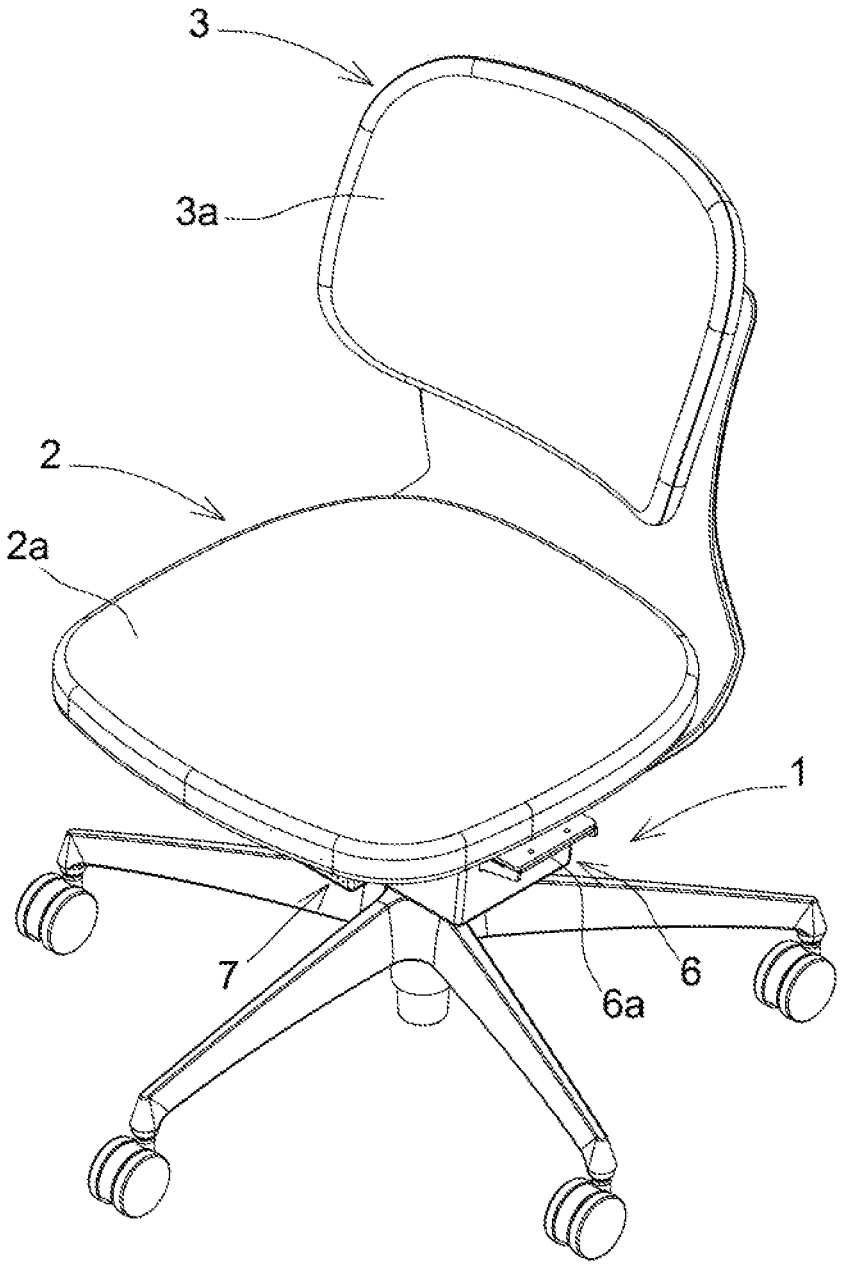
FIG. 1 is a perspective view of a chair according to a first embodiment of the present invention.
Figure 2:
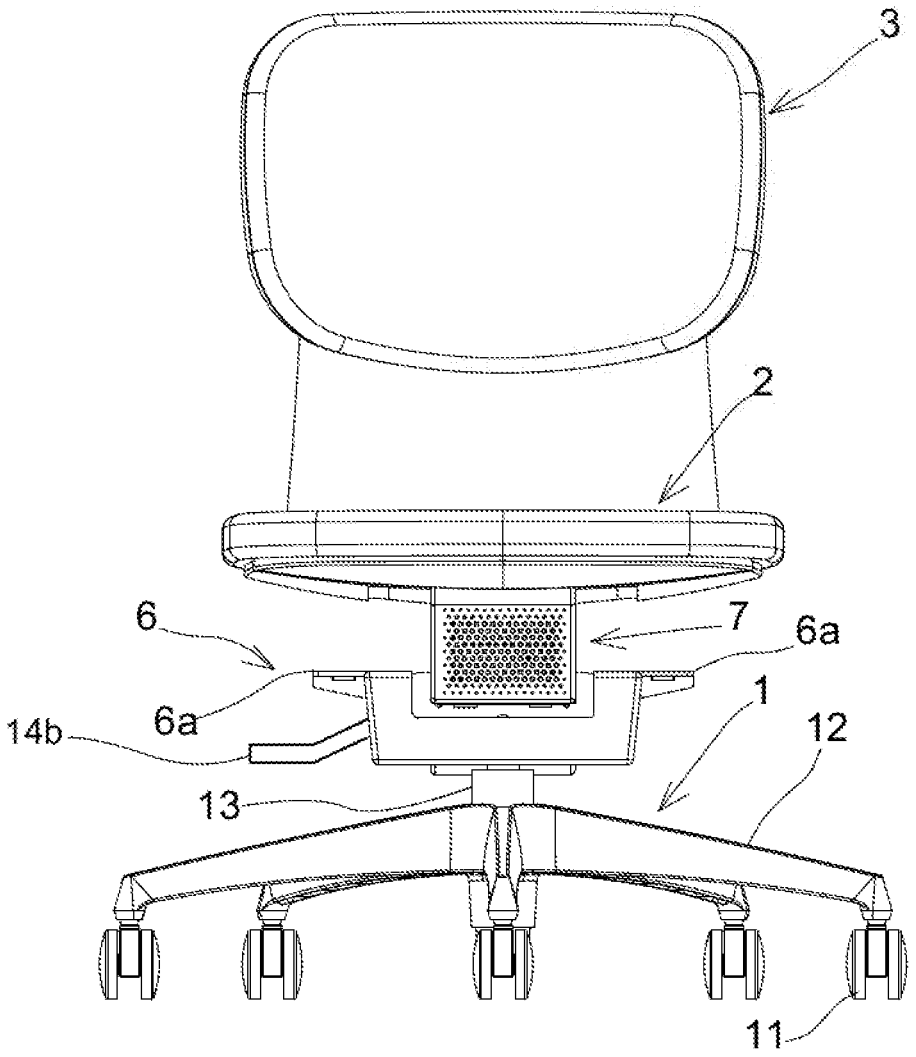
FIG. 2 is a front view of the chair according to the first embodiment of the present invention.
Figure 3:
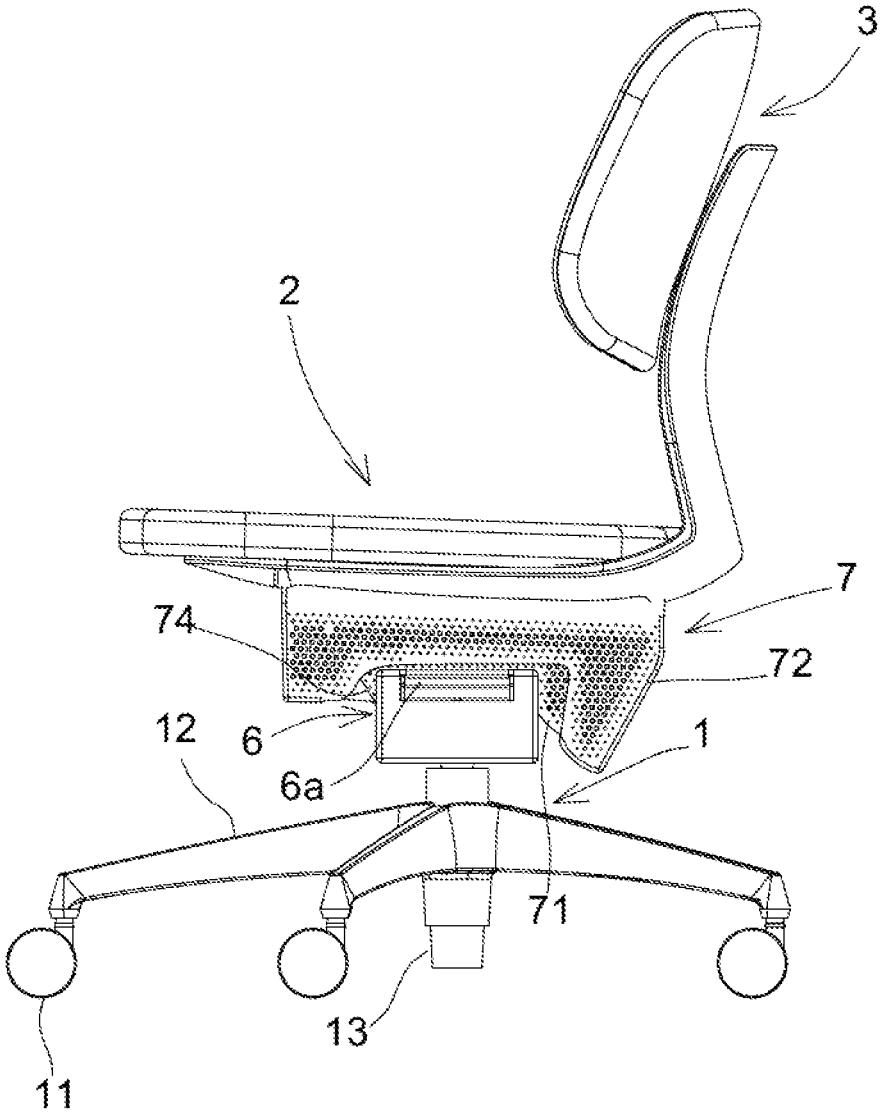
FIG. 3 is a right-side view of the chair according to the first embodiment of the present invention.
Figure 4:
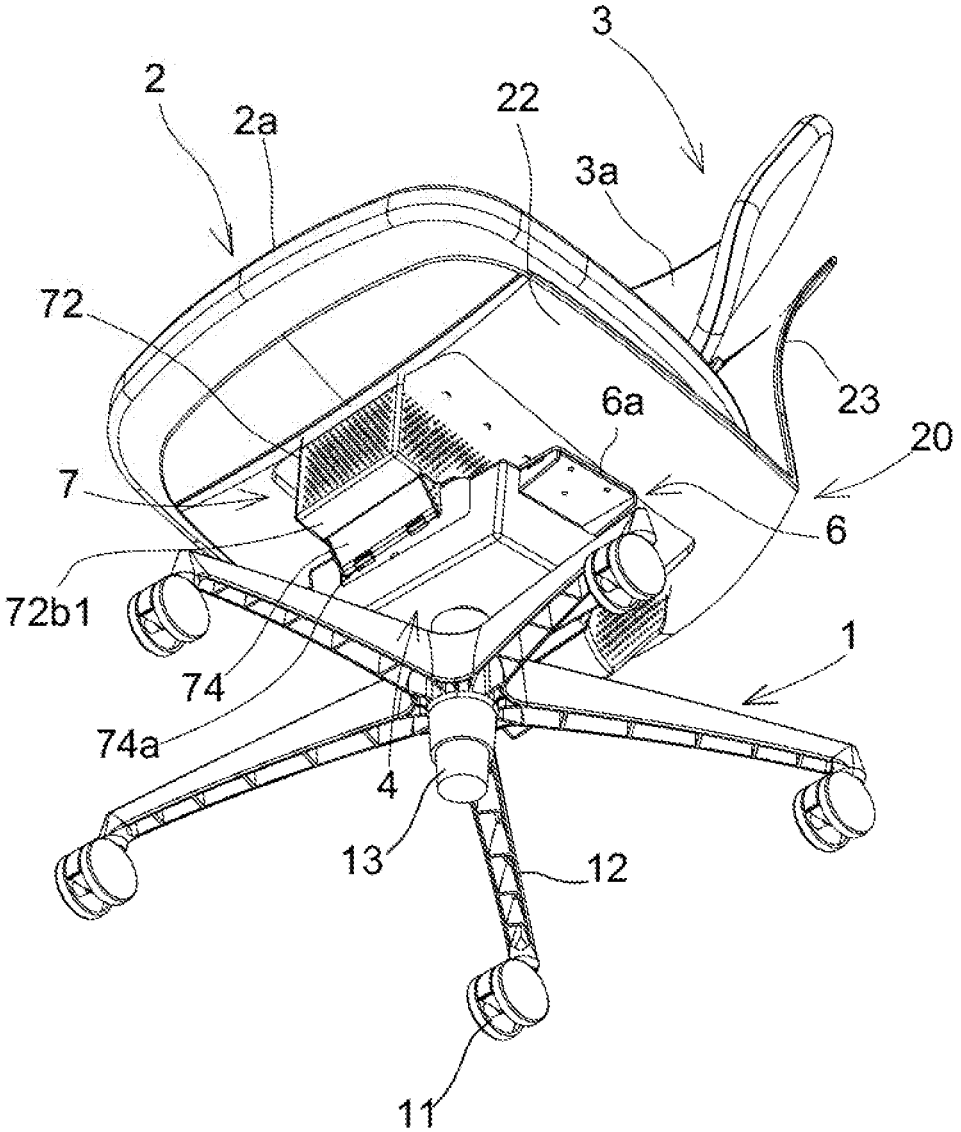
FIG. 4 is a lower perspective view of the chair according to the first embodiment of the present invention.
Figure 5:
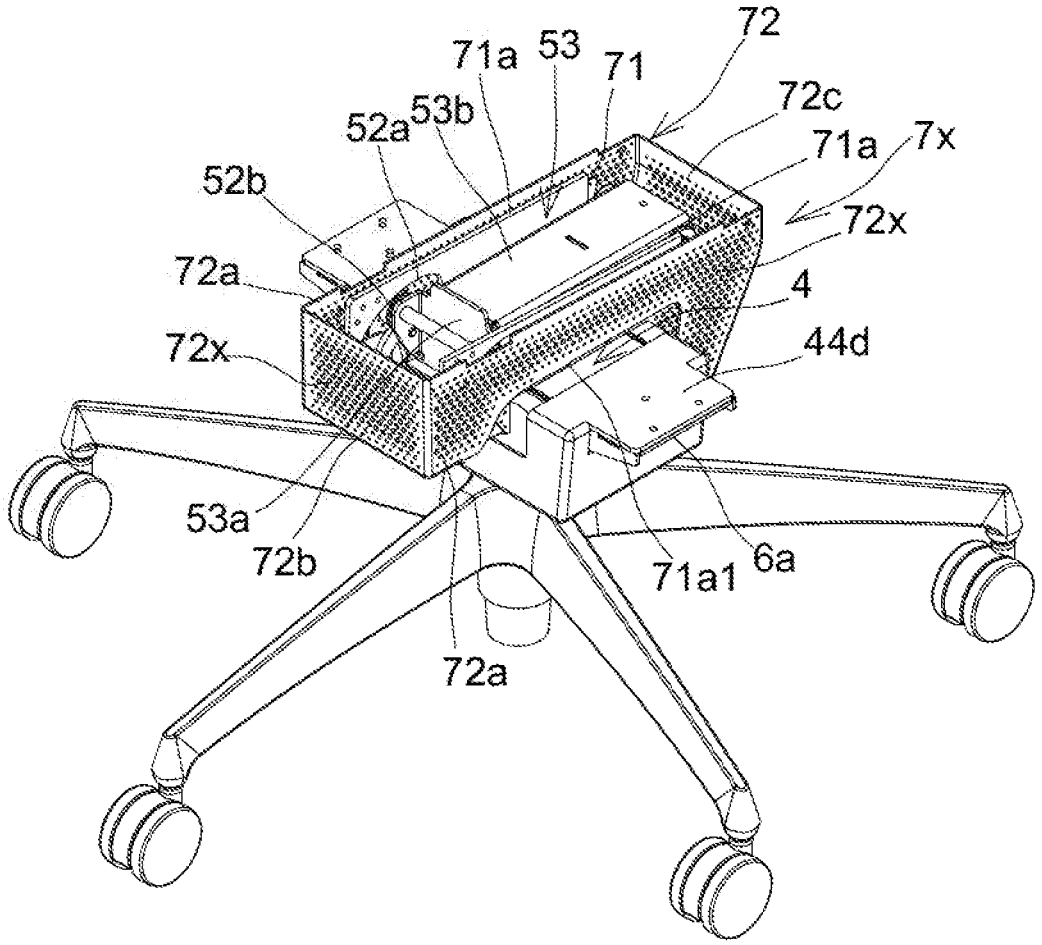
FIG. 5 is a perspective view illustrating a state of the chair according to the first embodiment of the present invention from which components located above a seat are removed.
Figure 6:
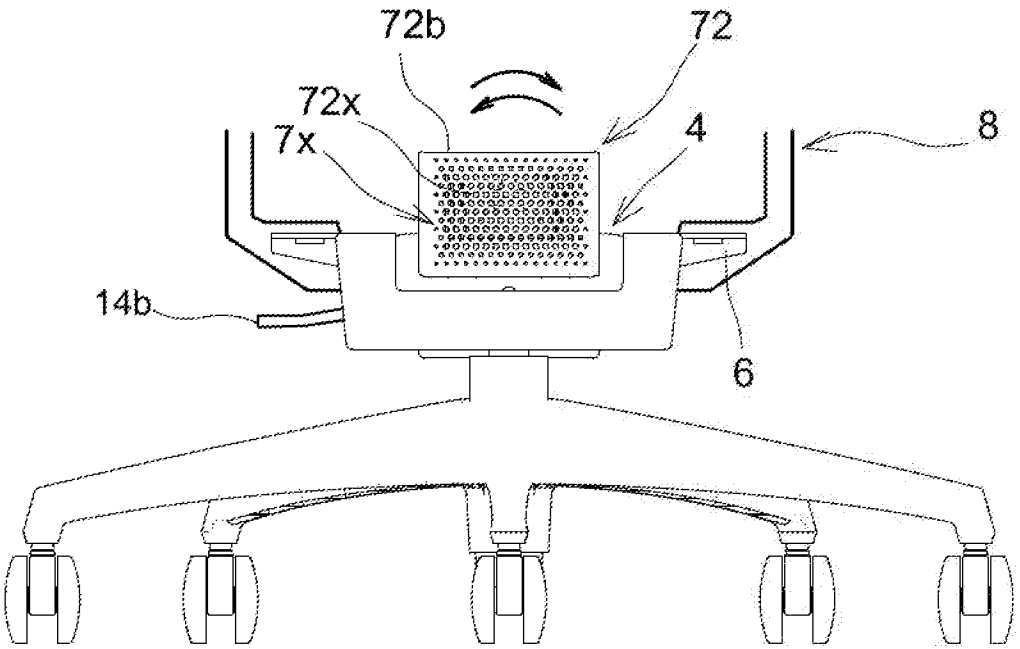
FIG. 6 is a front view illustrating a state of the chair according to the first embodiment of the present invention from which components located above a seat are removed.
Figure 7:
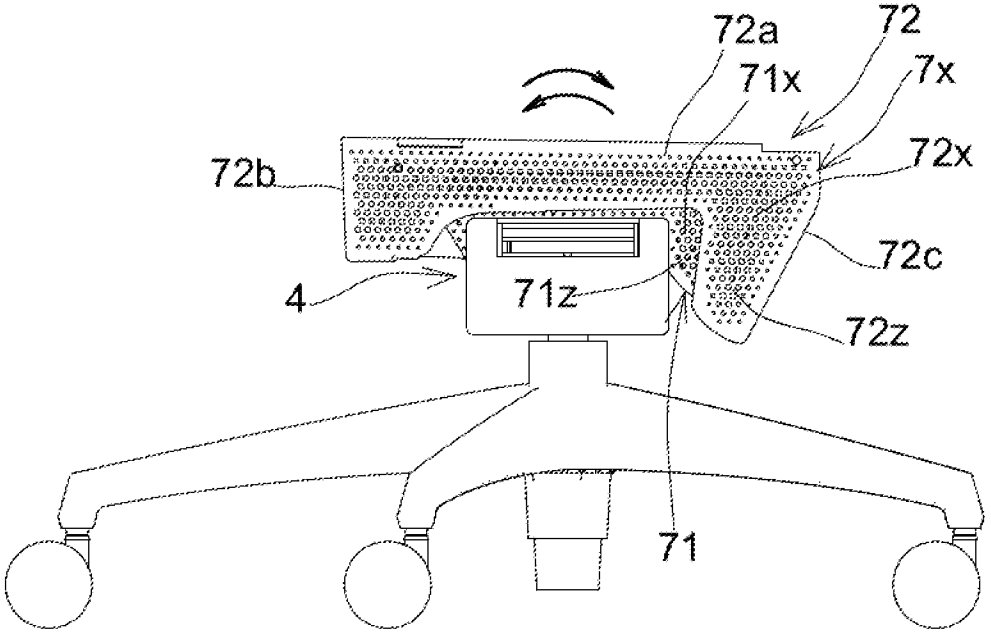
FIG. 7 is a right-side view illustrating a state of the chair according to the first embodiment of the present invention from which components located above a seat are removed.
Figure 8:
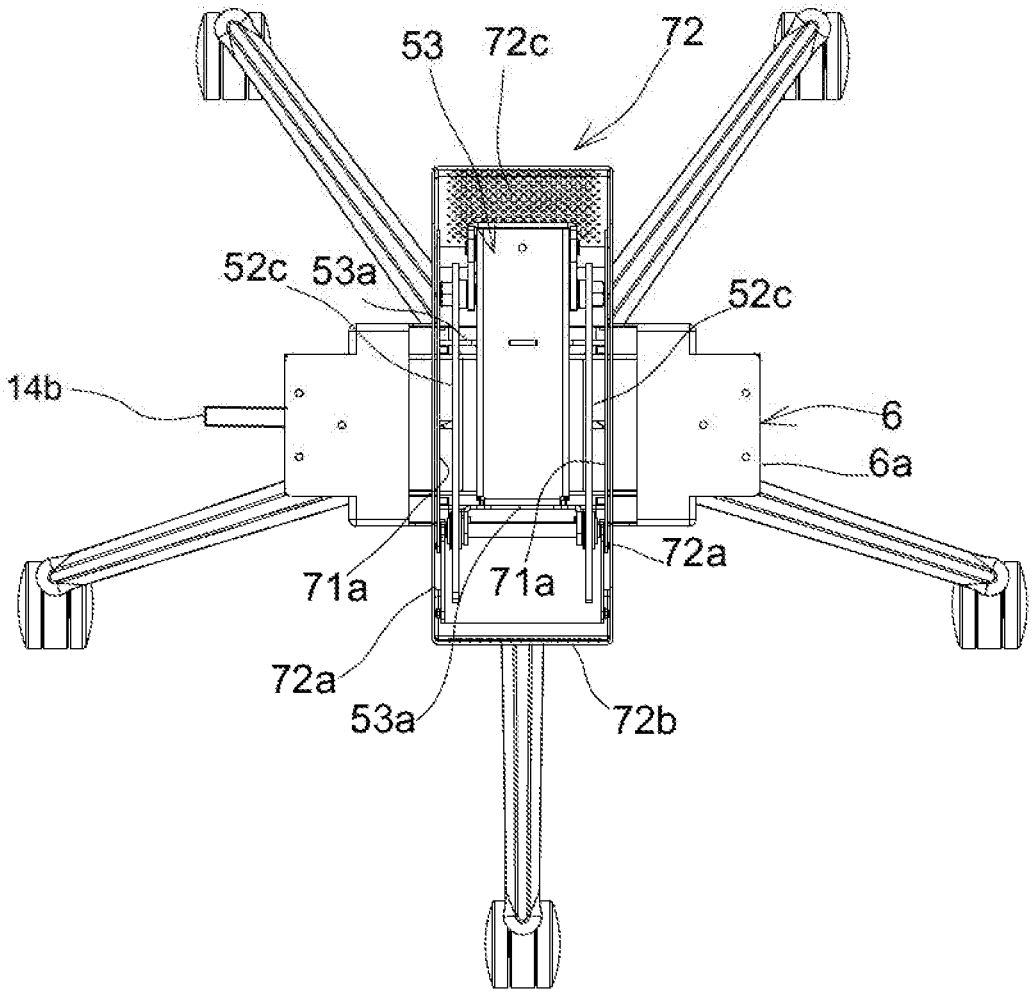
FIG. 8 is a plan view illustrating a state of the chair according to the first embodiment of the present invention from which components located above a seat are removed.
Figure 9:
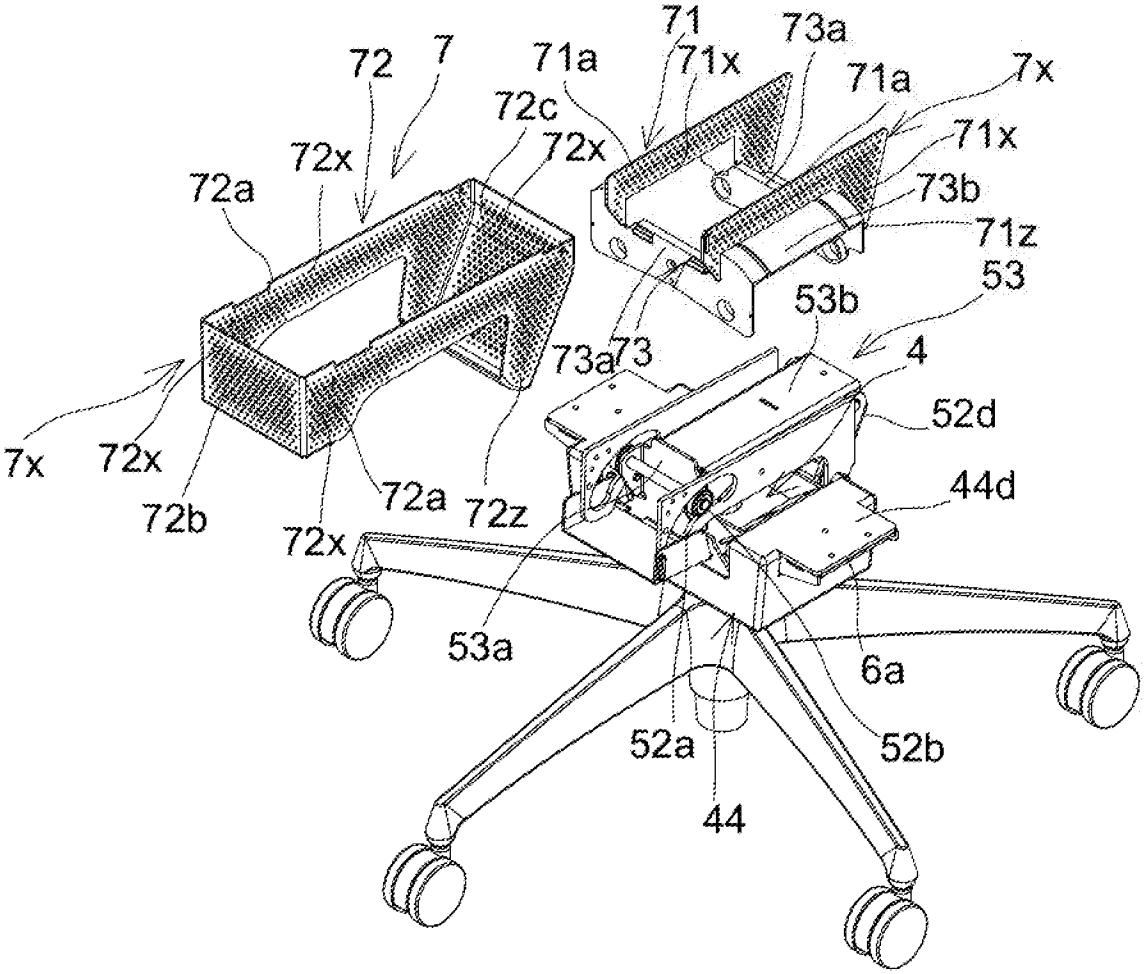
FIG. 9 is a partially exploded perspective view of FIG. 5.
Figure 10:
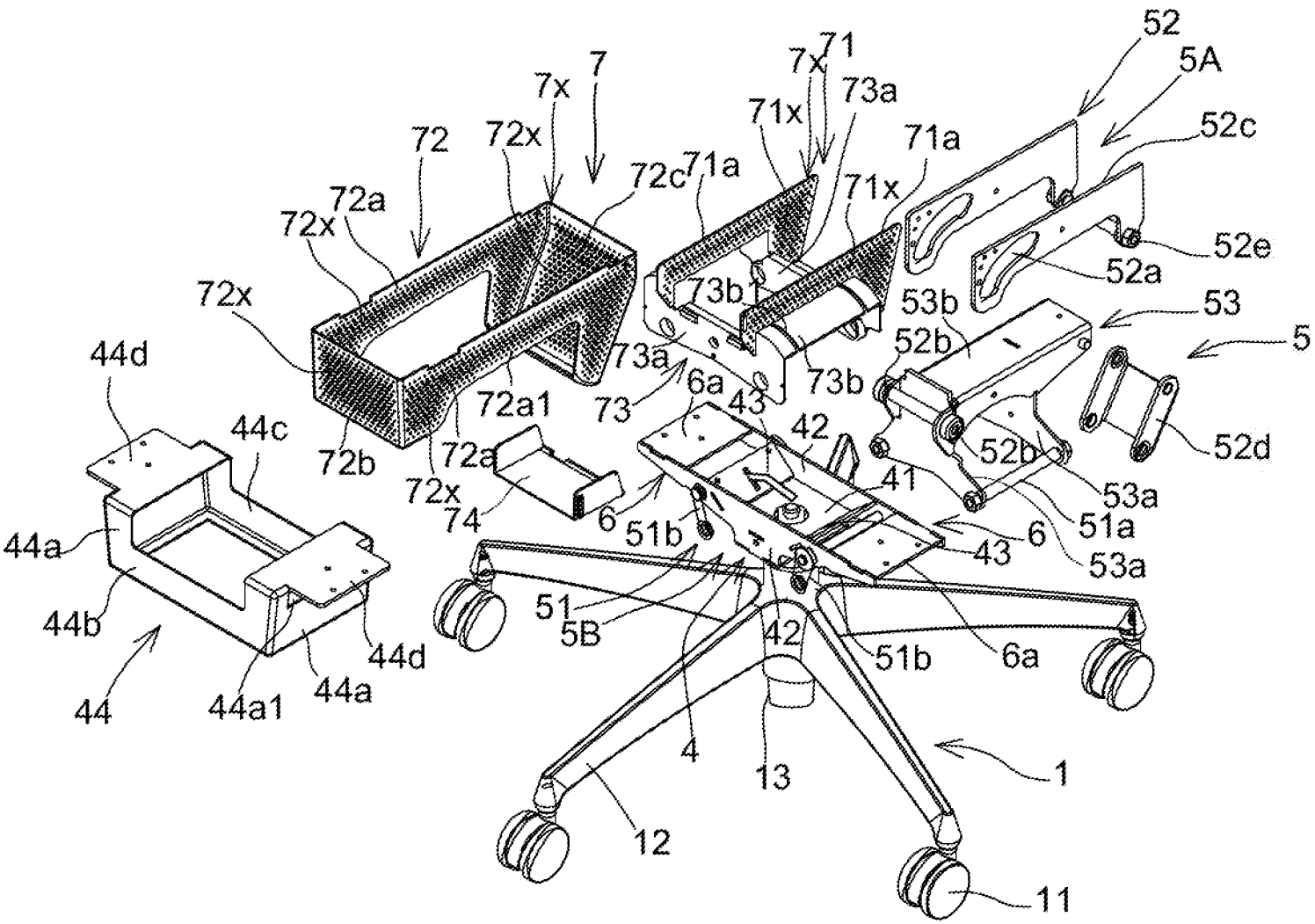
FIG. 10 is a further exploded perspective view of FIG. 9.
Figure 11:
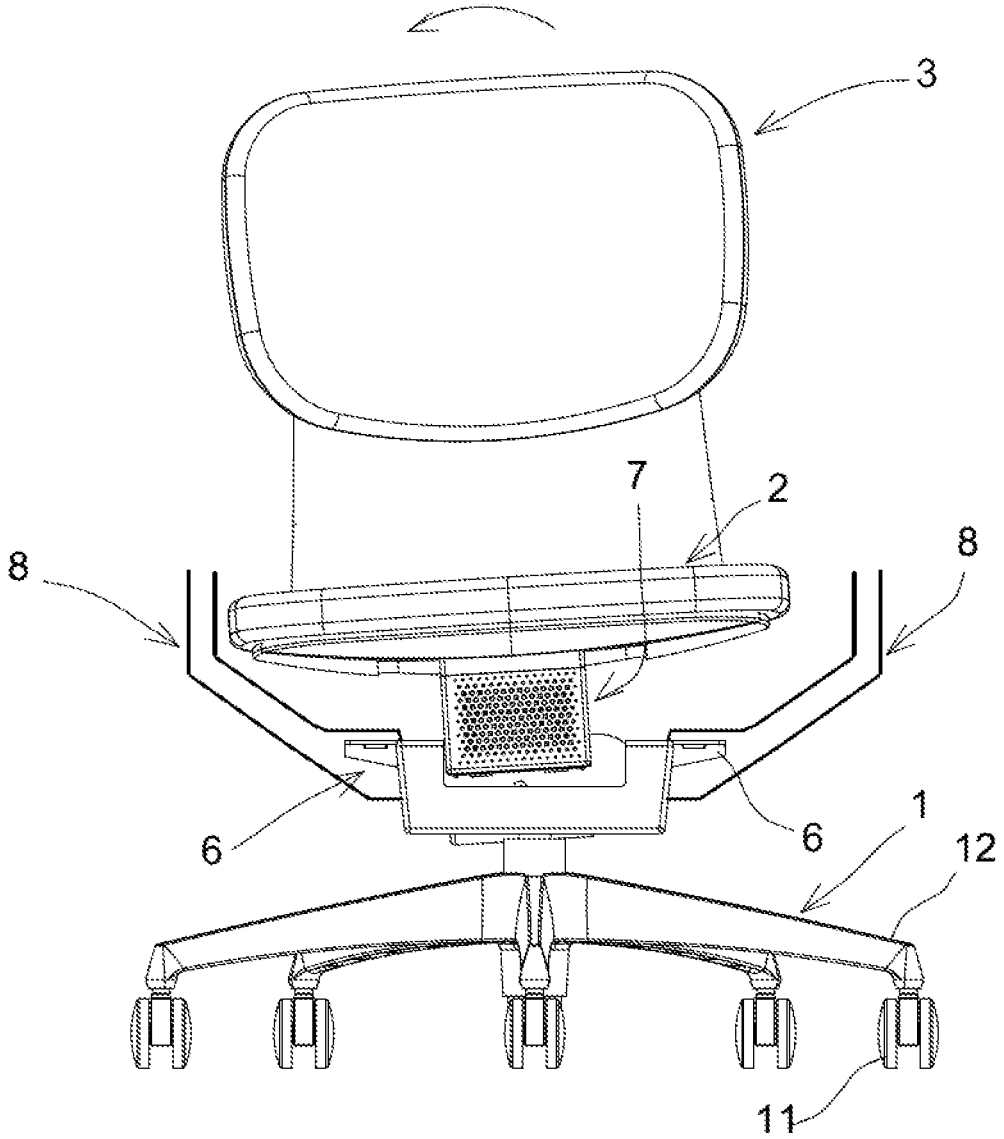
FIG. 11 is an explanatory diagram of movement according to the first embodiment of the present invention.
Figure 12:
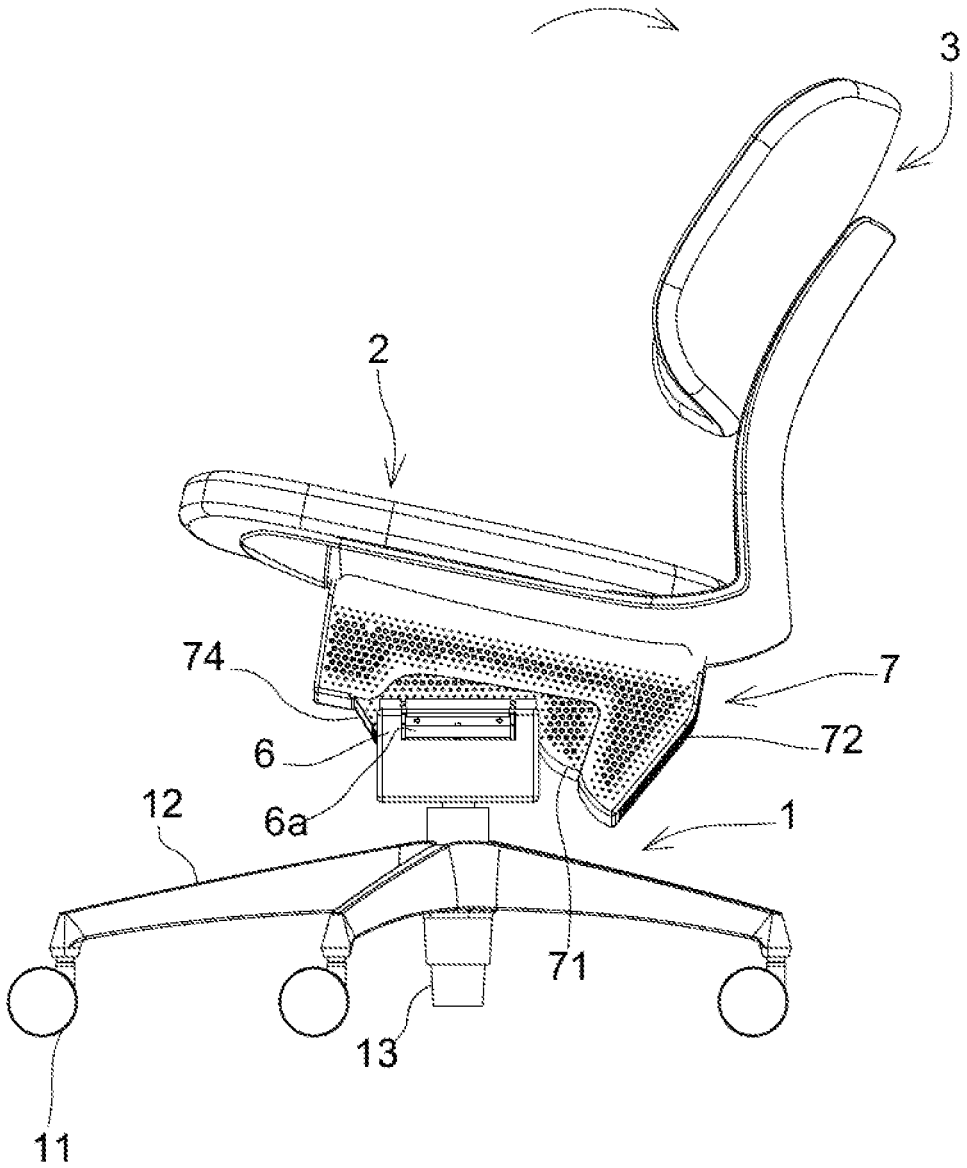
FIG. 12 is an explanatory diagram of movement according to the first embodiment of the present invention.

FIG. 1 is a perspective view of a chair according to the first embodiment. FIG. 2 is a front view of the chair according to the first embodiment. FIG. 3 is a right-side view of the chair according to the first embodiment. FIG. 4 is a lower perspective view of the chair according to the first embodiment. In addition, FIG. 5 is a perspective view illustrating a state of the chair according to the first embodiment from which components located above a seat are removed. FIG. 6 is a front view illustrating a state of the chair according to the first embodiment from which the components located above the seat are removed. FIG. 7 is a right-side view illustrating a state of the chair according to the first embodiment from which the components located above the seat are removed. FIG. 8 is a plan view illustrating a state of the chair according to the first embodiment from which the components located above the seat are removed. FIG. 9 is a partially exploded perspective view of FIG. 5. FIG. 10 is a further exploded perspective view of FIG. 9. FIGS. 11 and 12 are explanatory drawings each illustrating movement of the whole chair.

As illustrated in these drawings, the chair includes a leg 1 provided to stand from a floor surface, a seat 2 and a backrest 3 that are disposed above the leg 1, a leg support pole 13 attached to the leg 1 to support the seat 2 so that the seat 2 moves up or down and can rotate, a support base 4 fixed to an upper end of the leg support pole 13 and configured to horizontally rotate integrally with the leg support pole 13 and so as not to move in a front-rear and left-right directions in accordance with movement of the seat 2, a movement mechanism 5 interposed between the support base 4 and the seat 2 to support the seat 2 so that the seat 2 can move in the front-rear and left-right directions, an arm attachment part 6 supported by the support base 4, and a movable cover member 7 to cover the movement mechanism 5.

The seat 2 and the backrest 3 are integrally formed in the first embodiment. As illustrated in FIG. 4, a seat component 2*a* is attached to a seat corresponding portion 22 of an integral seat backrest outer shell 20, and a backrest component 3*a* is attached to a backrest corresponding portion 23 of the integral seat backrest outer shell 20. Even if the chair has a synchronized seat and backrest locking structure such that the seat 2 moves in the same direction in conjunction with the backrest 3 at a constant rate in accordance with the forward or backward tilting movement of the backrest 3, a support mechanism 5 of the first embodiment is obviously applicable to support the seat 2.

The leg 1 includes a leg blade 12 supported by casters 11, and the leg support pole 13 is fitted into a center hole of the leg blade 12. The leg support pole 13 is configured such that an upper support pole is rotatable relative to a lower outer cylinder. The support base 4 is attached to the rotatable upper support pole as illustrated in FIG. 10 or other drawings. The leg support pole 13 is a gas spring 14 that is a lifting up and down mechanism body configuring a lifting up and down mechanism. An operation end 14*a* of the gas spring 14 is arranged at an end position of the gas spring 14 penetrating through the support base 4.

The support base 4 is formed of a strengthening member integrally provided with a bottom wall 41, a pair of front-rear walls 42, and a pair of side walls 43 to form a ship shape. The bottom wall 41 is attached to the leg support pole.

The movement mechanism 5 supports the seat 2 and the backrest 3 so that each of the seat 2 and the backrest 3 moves in a certain area along a predetermined trajectory in plural directions. Specifically, the movement mechanism 5 includes a front-rear movement part 5A allowing a front-rear movement of the seat and the backrest and a left-right movement part 5B allowing a left-right movement of the seat and the backrest. The movement mechanism 5 not only moves the seat 2 and the backrest 3, but also functions as the support mechanism to support a load while moving the seat 2 in the front-rear and left-right directions. Herein, the movement mechanism 5 will be also referred to as the support mechanism 5 as required.

The support mechanism 5 includes a left-right support part 51 supporting the seat 2 movably in the left-right direction, and a front-rear support part 52 supporting the seat 2 movably in the front-rear direction.

The left-right support part 51 is configured such that left-right support portions as supported members, i.e., a pair of shafts 51*a*, are supported thought a link members 51*b* as left-right support members to suspend and support downward from the support base 4 as a support member. The pair of shafts 51*a* is supported to be swingable in the left-right direction. The shafts 51*a* are arranged below the support base 4. That is, the pair of shafts 51*a* as the left-right support portions is connected to the link members 51*b* to move in conjunction with the link members 51*b* as the left-right support members.

The front-rear support part 52 is attached though a connection member 53 to the pair of shafts 51*a* as the left-right support portions. The connection member 53 includes a pair of front and back brackets 53*a* to which the pair of shafts 51*a* is attached, and a swingable body 53*b* attached above the brackets 53*a* to hang over the support base 4 and formed in a box shape opening downward. In addition, front end portions of seat support walls 52*c* as front-rear support portions are supported on a front end portion of the swingable body 53*b* though cam surfaces 52*a* and cam followers 52*b*, both of which are front-rear support members. Rear end portions of the seat support walls 52*c* as the front-rear support portions are supported on a rear end portion of the swingable body 53*b* though a link member 52*d* as a front-rear support member. That is, the seat support walls 52*c* as the front-rear support portions are arranged above the support base 4. Further, in the first embodiment, as an example that the cam followers 52*b* are indirectly provided on the swingable body 53*b*, a mode that upper ends of the front bracket 53*a* of a sheet metal material fixed to the front end portion of the swingable body 53*b* are bent forward and the cam followers 52*b* are pivotally attached to the bent portions, is applied. That is, the seat support walls 52*c* as the front-rear support portions are connected to move in conjunction with the cam surfaces 52*a*, the cam followers 52*b*, and the link member 52*d*, all of which are the front-rear support members.

In addition, the seat 2 is attached to upper ends of the seat support walls 52*c*.

Each of the link members 51*b* of the left-right support part 51 is formed in a shape expanding from a reference position toward the upper side. Therefore, inside a cover member 72 described below based on FIG. 6, is configured to downwardly incline a tip side in a movement direction of the link member 51*b* as indicated by arrows in FIG. 6 in accordance with swinging of the shafts 51*a* as the left-right support portions from the reference position. In addition, as being dislocated from the reference position, the link members 51*b* move such that a center position between the shafts 51*a*, 51*a* is elevated.

Furthermore, the seat support walls 52*c* being the front-rear support portions is set so that the front end portion is supported at an intermediate position of the cam surface 52*a* inclining forward and downward from a reference position, by the cam follower 52*b* and the rear end portion is supported by the link member 52*d* hanging forward and downward from a reference position. Accordingly, inside the front-rear cover member 72 described below based on FIG. 7, when the seat support wall 52*c* as the front-rear support portion moves forward from the reference position, the front end thereof is moved downward, and the rear end thereof is moved upward. Meanwhile, when the seat support wall 52*c* moves rearward, the front end thereof is moved upward and the rear end thereof is moved downward, and in addition, as being dislocated from the reference position, the seat support wall 52*c* moves such that a center position of the seat support wall 52*c* is elevated.

As a result, the seat 2 can move in the left-right direction while moving in the front-rear direction, and a moving tip side of the seat 2 inclines downward, as being dislocated from a reference position, the seat 2 is supported such that a center position of the seat 2 is elevated.

The arm attachment parts 6 are integrally provided on the support base 4 and ends 6*a* of the respective arm attachment parts 6 are located at positions laterally extended from the support base 4 to the right side and the left side.

Specifically, the front-rear support part 52 is located above an upper portion of the support base 4 attached to an upper portion of the leg support pole 13, and the left-right support part 51 is disposed below the upper portion of the support base 4. Therefore, a space for extending the arm attachment parts 6 exists between the front-rear support part 52 and the left-right support part 51. Consequently, the arm attachment parts 6 can be formed in a manner to be laterally extended without interfering with the front-rear support part 52 and the left-right support part 51.

More specifically, the link members 51*b* as a pair of right and left support members are pivotally attached to the support base 4 to suspend therefrom. The cam surfaces 52*a* and the cam followers 52*b*, which are a pair of front and back support members, are arranged though the bracket 53*a* from the shafts 51*a* as the left-right support portions supported by the link members 51*b*, and a link shaft 52*e* is arranged through the bracket 53*a* from the shafts 51*a*. Further, the seat support walls 52*c* as the front-rear support portions are attached to the cam surfaces 52*a*, the cam followers 52*b* and the link member 52*d*. Furthermore, the seat 2 is attached to the seat support walls 52*c*. That is, the link members 51*b* are provided to suspend from the support base 4 and thereby the shafts 51*a* as the left-right support portions located at lower ends of the link members 51*b* are arranged below the support base 4 and located separately from each other. In addition, the seat support walls 52*c* substantially horizontally shift while swinging when being moved in the front-rear direction by the cam surfaces 52*a*, the cam followers 52*b* and the link member 52*d*, and thus do not largely move up and down. Therefore, a space for extending the arm attachment parts 6 and an attachment place for attaching the seat 2 are appropriately secured.

A fixation cover 44 is attached to the support base 4. The fixation cover 44 is integrally provided in a frame shape in planar view with right and left side fixation walls 44*a*, a front fixation wall 44*b*, and a back fixation wall 44*c*, and arm fixation portions 44*d* are integrally provided to laterally extend between an intersection between each of the side fixation walls 44*a* and the front fixation wall 44*b* and an intersection between each of the side fixation walls 44*a* and the back fixation wall 44*c*. Various specific attachment procedures may be taken. The support base 4 is arranged in the frame-shaped space of the fixation cover 44, and the arm attachment parts 6 are arranged to be laterally extend through openings 44*al* formed in the respective side walls 44*a* of the fixation cover 44 in with lower portions of the respective arm fixation portions 44*d*.

Further, an operation lever 14*b* illustrated in FIG. 2 and configured to operate the operation end 14*a* of the gas spring 14 is disposed on a lower surface of one of the arm fixation portions 44*d*.

Furthermore, as illustrated in FIG. 6 and FIG. 11, arms 8 are detachably attached to the arm attachment parts 6. In addition, each of the arms 8 is fixed to the arm attachment part 6 from the lower or lateral side of the arm attachment part 6 by a fastening member such as a bolt.

On the other hand, as illustrated in FIG. 10, the movable cover member 7 includes a left-right cover member 71 attached to the left-right support part 51, a front-rear cover member 72 attached to the front-rear support part 52, and an interpolation cover member 74 interposed between the left-right cover member 71 and the front-rear cover member 72. The front-rear cover member 72, the left-right cover member 71, and the interpolation cover member 74 are configured in combination, therefore configuring the cover member 7. In addition, in accordance with movements of the plural movement parts 5A, 5B, the cover members 72, 71 move relatively in different directions in a certain area along a predetermined trajectory.

Specifically, the left-right cover member 71 includes a pair of right and left standing walls 71*a* each formed in a substantially L-shape. The left-right cover member 71 is attached to a cover attachment member 73. The cover attachment member 73 includes a pair of front and back support plates 73*a* and a cover plate 73*b* connecting between the support plates 73*a*, 73*a*. The support plate 73*a* is swingable attached to swing ends of the respective link members 51*b* together with the shafts 51*a* as the left-right support portions. In such an attaching state, the seat support walls 52*c* as the front-rear support portions are arranged inside the front-rear cover member 72, and the seat support walls 52*c* swing in the left-right direction together with the front-rear cover member 72.

In addition, as illustrated in FIG. 11, in accordance with the left-right swinging of the seat support walls 52*c*, the seat 2 fixed to the seat support walls 52*c* swings in the left-right direction together with the backrest 3. FIG. 11 illustrates an operation in which the seat 2 swings to the left side of FIG. 11. Likewise, obviously, the seat 2 may swing to the right of FIG. 11.

Here, the arms 8 detachably attached to the arm attachment parts 6 provided on the support base 4 do not move in accordance with the swinging of the seat 2. In addition, each of the arms 8 is shaped not to make contact with the seat 2 even at a swing end of the seat 2 in the left-right direction.

Meanwhile, the front-rear cover member 72 is configured such that right and left standing side walls 72*a*, a front wall 72*b*, and a back wall 72*c* tilted rearward are connected in a frame shape in planar view. The front-rear cover member 72 includes a space inside thereof in which the left-right cover member 71 can be housed. The front-rear cover member 72 is attached to the seat support walls 52*c* as the front-rear support portions, and configure so that while the front-rear cover member 72 swings together with the seat support walls 52*c* in the left-right direction and the front-rear direction, the cam surfaces 52*a* and the cam followers 52*b*, both of which are the front-rear support members, are covered and hidden by the side walls 72*a* and the front wall 72*b*, and the link member 52*d* as the front-rear support member is covered and hidden by the side walls 72*a* and the back wall 72*c*. Therefore, each of the side walls 72*a* is formed in a reversed L-shape. In addition, as illustrated in FIG. 4, a front bottom wall 72*b*1 substantially horizontally disposed is provided at a lower end portion of the front wall 72*b*. The front bottom wall 72*b*1 is consistently contactable with a portion of the interpolation cover member 74.

Meanwhile, the interpolation cover member 74 is interposed between the left-right cover member 71 and the front-rear cover member 72. Specifically, the interpolation cover member 74 is rotatably engaged though a shaft 74*a* with an upper end on the front side of the cover attachment member 73, therefore being rotatably attached in the front-rear direction.

A space in which an opening between the facing side walls 71*a*, 71*a* of the left-right cover member 71 is communicated with an opening between the facing side walls 72*a*, 72*a* of the front-rear cover member 72 corresponds to a space in which the foregoing connection member 53 to connect the left-right support part 51 to the front-rear support part 52 is arranged.

As illustrated in FIGS. 5 and 8, each of the side walls 72*a* of the front-rear cover member 72 is located adjacent to each of the side walls 71*a* of the left-right cover member 71; however, the front-rear cover member 72 swings together with the left-right cover member 71 in the left-right direction and therefore a gap between the side wall 72*a* and the side wall 71*a* is maintained. Meanwhile, the left-right cover member 71 does not swing in the front-rear direction, and the front-rear cover member 72 swings in the front-rear direction. Therefore, gaps are provided between the front wall 72*b* of the front-rear cover member 72 and front ends of the respective side walls 71*a* of the left-right cover member 71 and between the back wall 72*c* of the front-rear cover member 72 and rear ends of the respective side walls 71*a* of the left-right cover member 71 such that the relative movement does not cause interference therebetween.

Thus, the cover member 7 is configured such that the left-right cover member 71 and the front-rear cover member 72 move relatively close to each other with the gap.

As just described, the cover members 71, 72 moves following in accordance with the movement of the seat 2, and in addition, can cover the support mechanism 5. That is, for the left-right movement of the seat 2, the cover members 71, 72 cover the support mechanism 5 while swinging in the left-right direction, as indicated by arrows in FIG. 6, in accordance with the left-right swinging of the left-right support part 51 configuring the support mechanism 5. In this case, recessed portions 72*al* are formed at lower portions of the respective side walls 72*a* of the front-rear cover member 72; therefore, even when swinging in the left-right direction, the front-rear cover member 72 is prevented from interfering with components of the support base 4. Also, as illustrated in FIG. 10, slits 73*b*1 are provided in the cover plate 73*b* of the cover attachment member 73 to which the left-right cover member 71 is attached. At the time of swinging, the front and back walls 42 of the support base 4 are received in the slits 73*b*1. Therefore, even when the cover attachment member 73 is arranged closely to the support base 4, an interference between the cover attachment member 73 and the support base 4 is avoided, and in addition, the role of a gap insertion plate to close a gap consistently inserted in the gap between the support base 4 and the left-right support part 52 is played.

Here, as illustrated in FIG. 12, the seat support walls 52*c* as the front-rear support portions are connected to move in conjunction with the cam surfaces 52*a*, the cam followers 52*b*, and the link member 52*d*, all of which are the front-rear support members. Therefore, the seat 2 fixed to the seat support walls 52*c* swings in the front-rear direction. FIG. 12 illustrates the swinging of the seat 2 to the back side, i.e., the swinging of the seat 2 to the right side of FIG. 12. Obviously, the seat 2 is swingable further forward than a state illustrated in FIG. 3.

For the front-rear movement of the seat 2 as above, in the same way as illustrated in FIG. 7, the front-rear cover member 72 swings in the front-rear direction in accordance with the front-rear swinging of the front-rear support part 52 configuring the support mechanism 5, but the left-right support part 51 does not swing in the front-rear direction. Therefore, a downward protrusion portion 71*z* forming the reversed L-shape of each of the side walls 71*a* of the left-right cover member 71 and a downward protrusion portion 72*z* forming the reversed L-shape of each of the side walls 72*a* of the front-rear cover member 72 cover together a movement range of the link member 52*d* to hide the movement range. In addition, the left-right cover member 71 closes a gap between each of the recessed portions 72*a* of the front-rear cover member 72 and the support base 4.

Consequently, even when the cover members 71, 72 execute a complex movement to each other, foreign objects are prevented from being trapped between the cover members 71, 72 or between the support base 4 and the cover members 71, 72.

On the other hand, at the time of the front-rear swinging of the seat 2 as illustrated in FIG. 12, the arms 8 detachably attached to the respective arm attachment parts 6 provided on the support base 4 do not move in accordance with the swinging of the seat 2. Further, as illustrated in FIG. 11, even at swinging movement end of the seat 2 in the left-right direction, each of the arms 8 does not make contact with the seat 2.

Furthermore, at the time of the front-rear movement of the seat 2, inside the front-rear cover member 72, the interpolation cover member 74 rotatably attached to a front end of the cover attachment member 73 rotates around the shaft 74*a* with respect to the left-right cover member. In other words, the interpolation cover member 74 rotates around the shaft 74*a* at a base end side with contacting to the front bottom wall 72*b*1 of the front-rear cover member 72 with leaning on the front bottom wall 72*b*1 at a tip end. Thus, generation of a gap between a front end portion of the left-right cover member 71 and the front-rear cover member 72 is effectively avoided.

Also, in the first embodiment, through-holes 7*x* each including a round hole are formed in any of the cover members 71, 72. The through-hole 7*x* includes through-holes 71*x*, 72*x* formed in the both cover members 71, 72 respectively in the first embodiment. The plural through-holes 71*x*, 72*x* are arranged lengthwise and breadthwise at equal intervals, moreover, at substantially equal pitches in the front-rear direction and the left-right direction entirely in respective surfaces. The hole diameter is designed to be small at a location adjacent to a rim of the cover member. Further, the through-holes 71*x*. 72*x* are arranged on the surfaces surrounding the movement mechanism 5 such that when one of the through-holes 71*x*, 72*x* is viewed from the outer surface side, other through-holes can be visually recognized from the inner surface side. In a location where the through-holes 71*x*, 72*x* are arranged on the two facing surfaces or the two adjoining surfaces of each of the cover members 71, 72, in particular, when one of the through-holes 71*x*, 72*x* is viewed from the outer surface side, other through-holes 71*x*, 72*x* is easily visually recognized from the inner surface side and thus light transmission properties are easily secured. Furthermore, since the through-holes 71*x*, 72*x* are arranged entirely in the standing surfaces, the light transmission properties are secured in any directions. The size and shape of the through-hole of the first embodiment is designed such that a cylinder with 8 mm in diameter is not allowed to insert into the through-hole. The aperture ratio of such through-holes 71*x*, 72*x* is preferably 10% or higher in each of the surfaces including the through-holes 71*x*, 72*x*, and is further preferably 15% or higher. It is to be noted that the shape of the through-hole 7*x* is not limited to a circle. Alternatively, through-holes of various shapes such as a slit-shaped through-hole or a cross-shaped through-hole may be applied as the through-hole 7*x*. Moreover, the through-holes 7*x* are arranged in the both cover members 71, 72, but not limited to such a configuration. Alternatively, the through-hole 7*x* may be arranged either one of the cover members (the cover member 71 or the cover member 72).

Second Embodiment

Hereinafter, a second embodiment of the present invention will be described with reference to the drawings. In the second embodiment, the same reference numbers are assigned to components corresponding to those of the foregoing first embodiment and detailed explanations of the components will be omitted.

Figure 13:
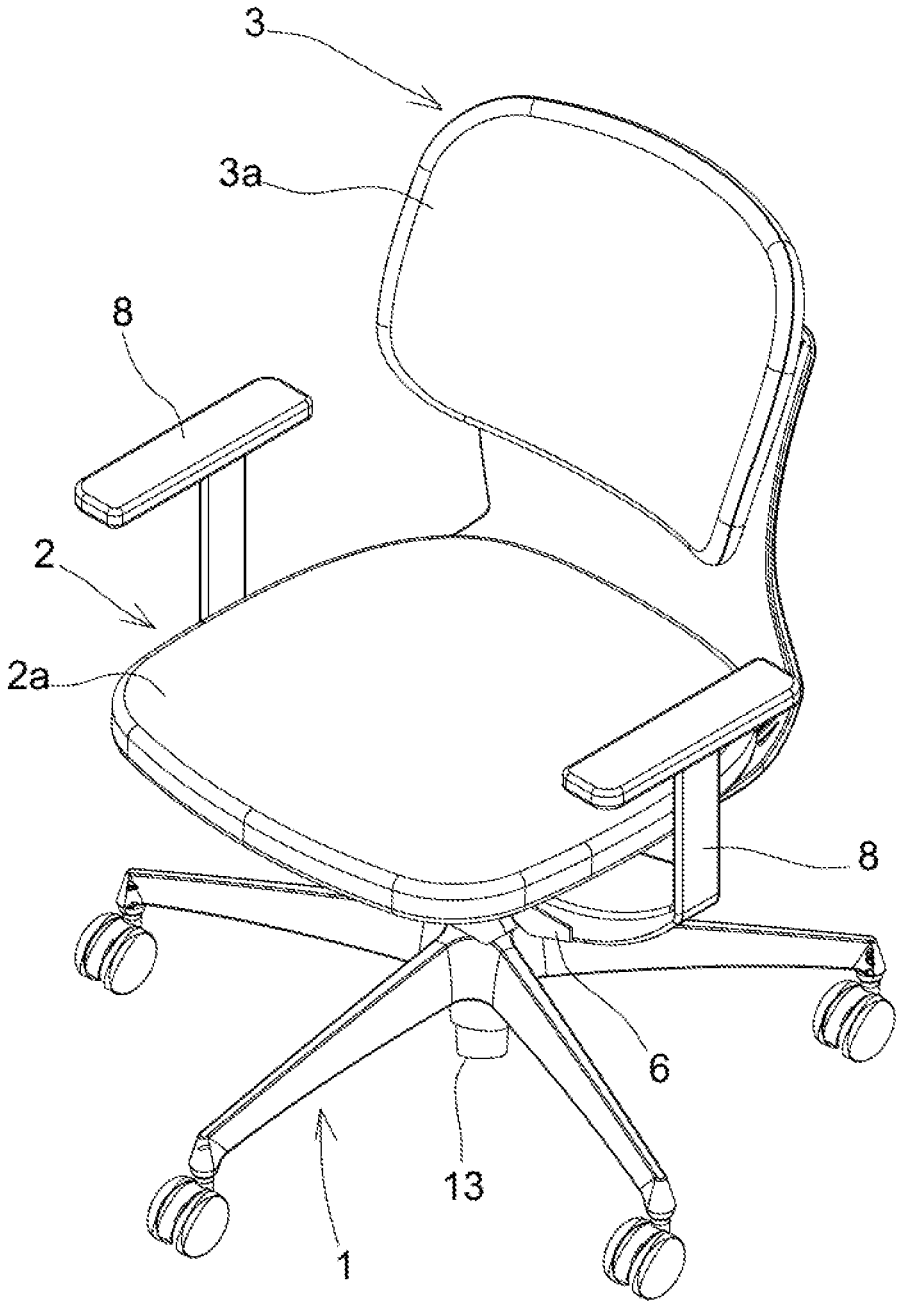
FIG. 13 is a perspective view of the chair according to a second embodiment of the present invention.
Figure 14:
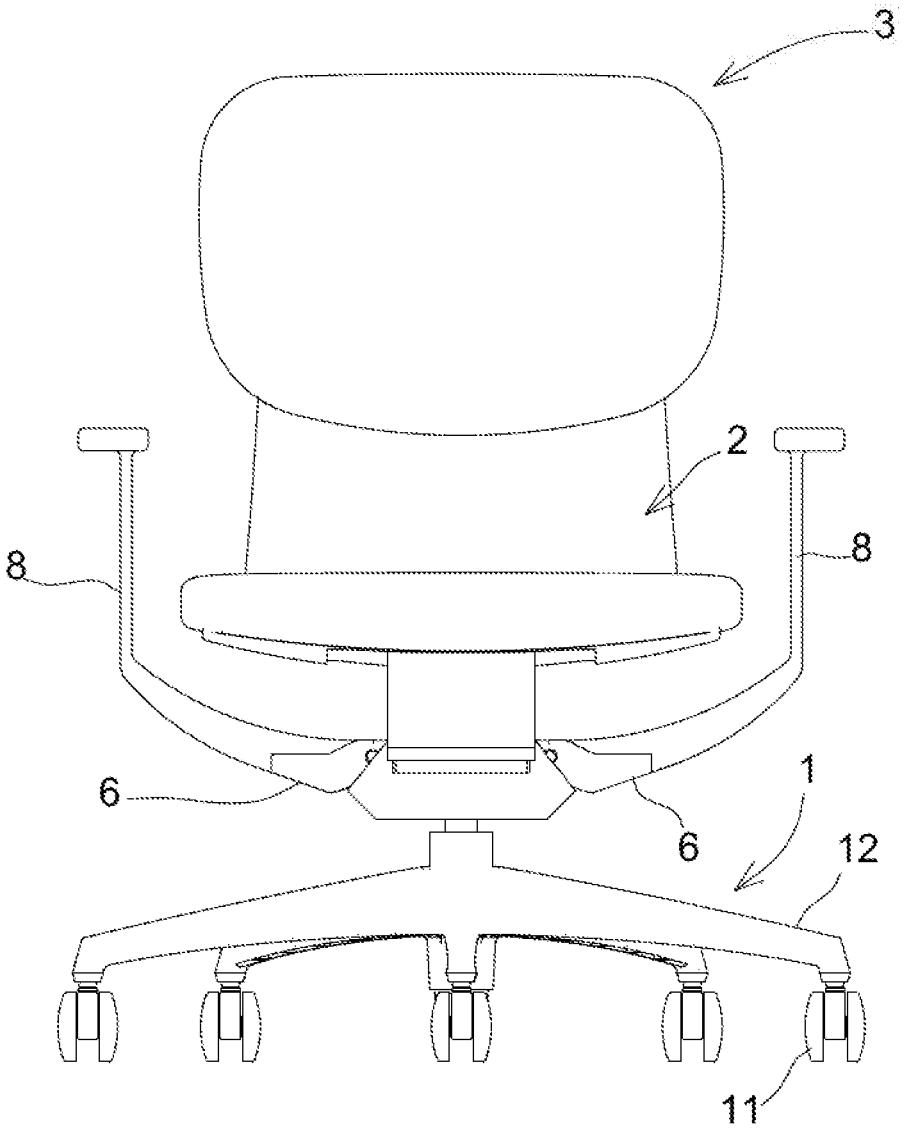
FIG. 14 is a front view of the chair according to the second embodiment of the present invention.
Figure 15:
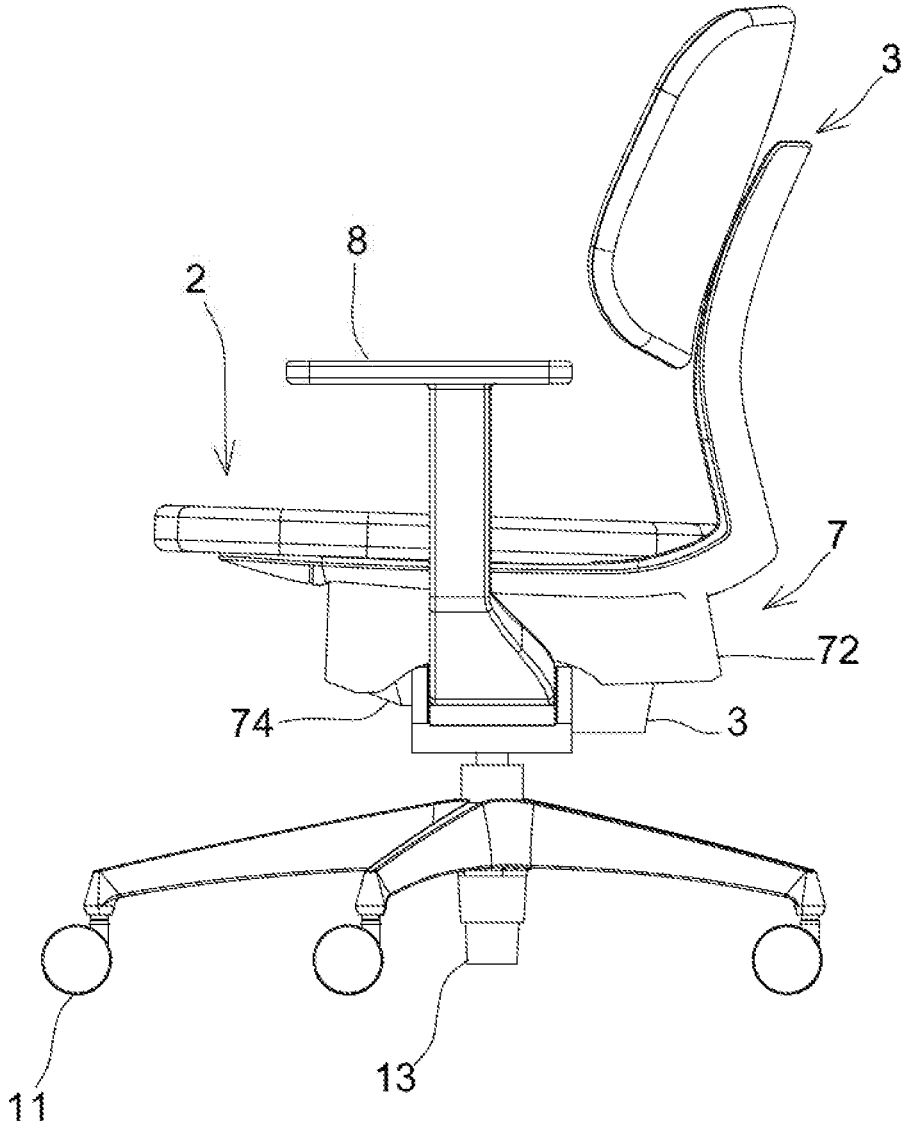
FIG. 15 is a right-side view of the chair according to the second embodiment of the present invention.
Figure 16:
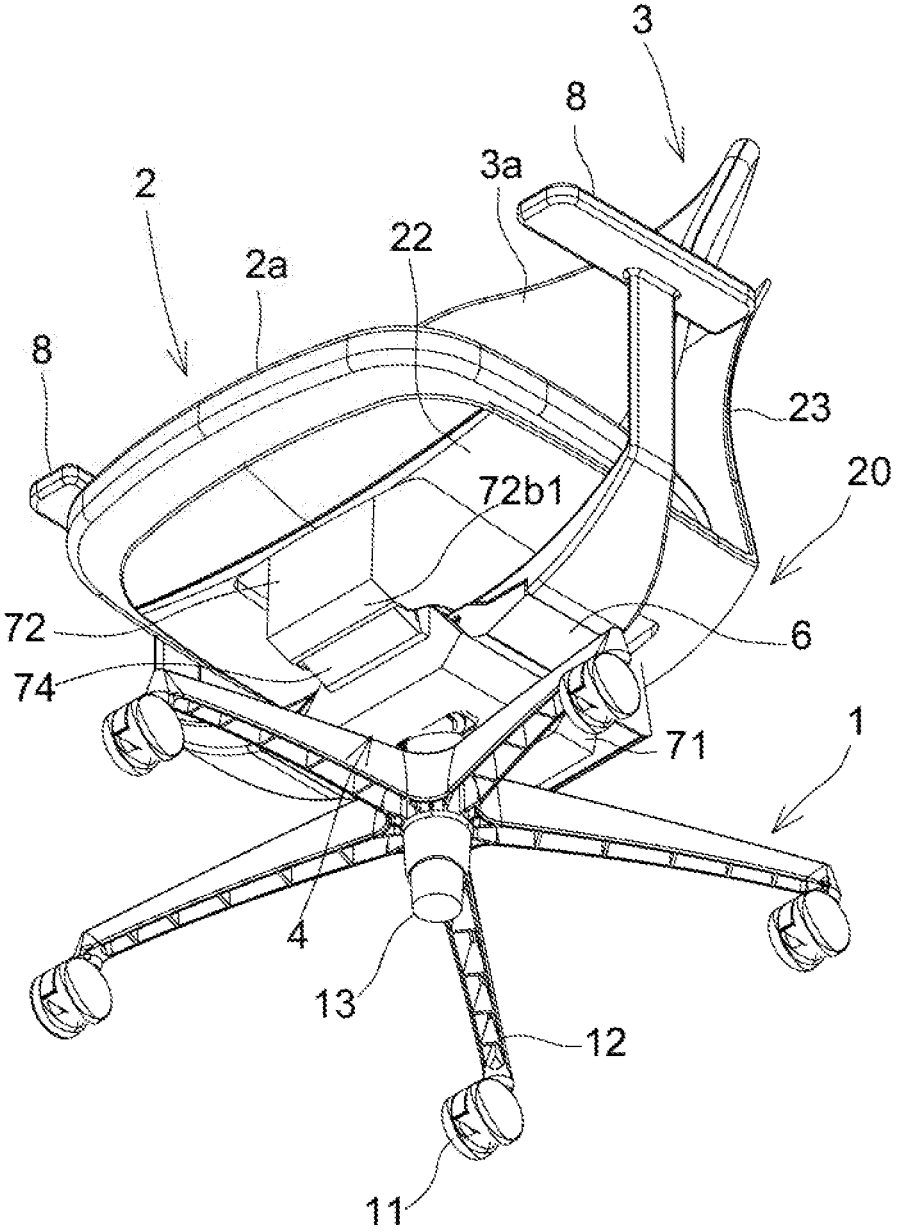
FIG. 16 is a lower perspective view of the chair according to the second embodiment of the present invention.
Figure 17:
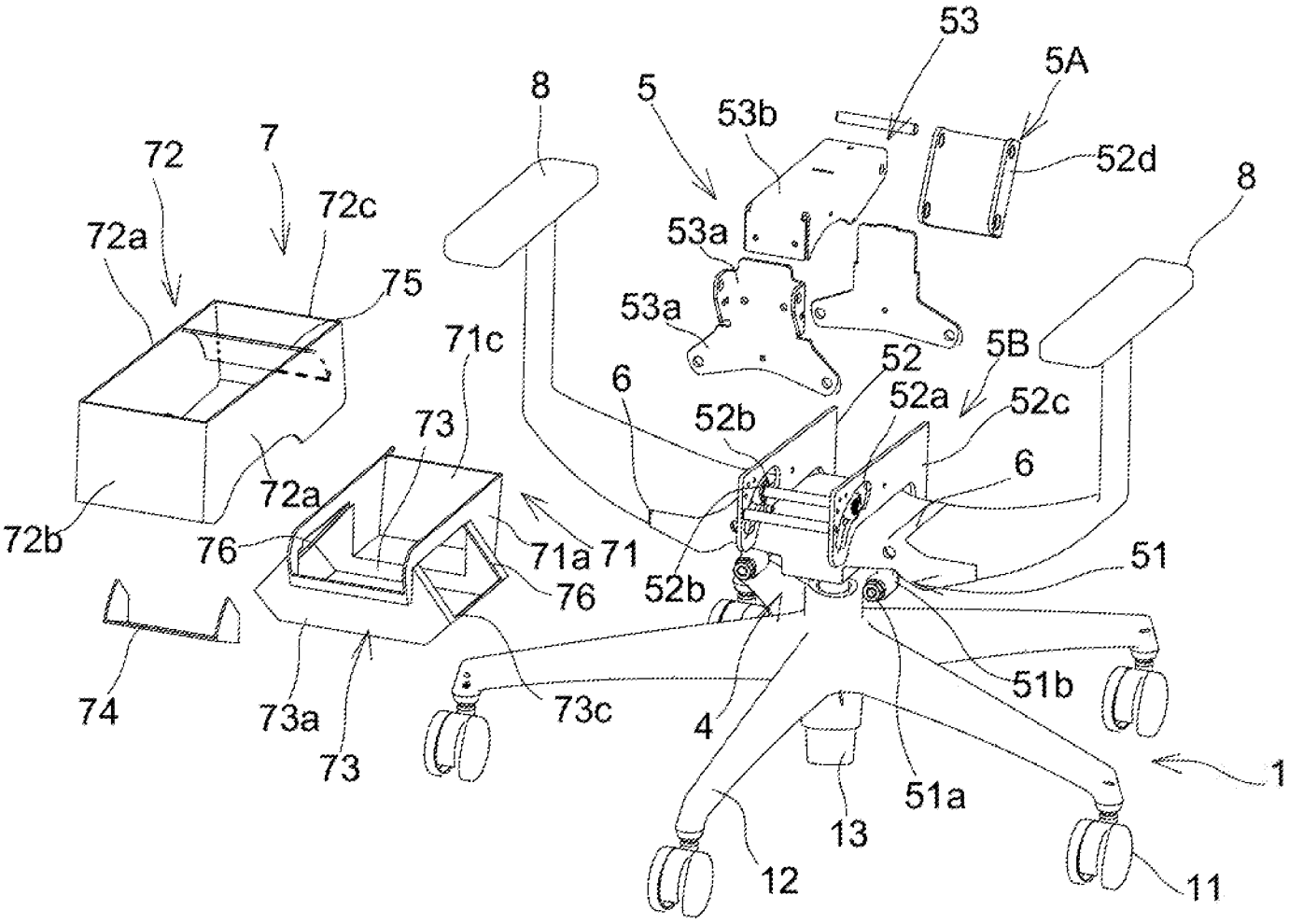
FIG. 17 is an exploded perspective view of major parts according to the second embodiment of the present invention.
Figure 18:
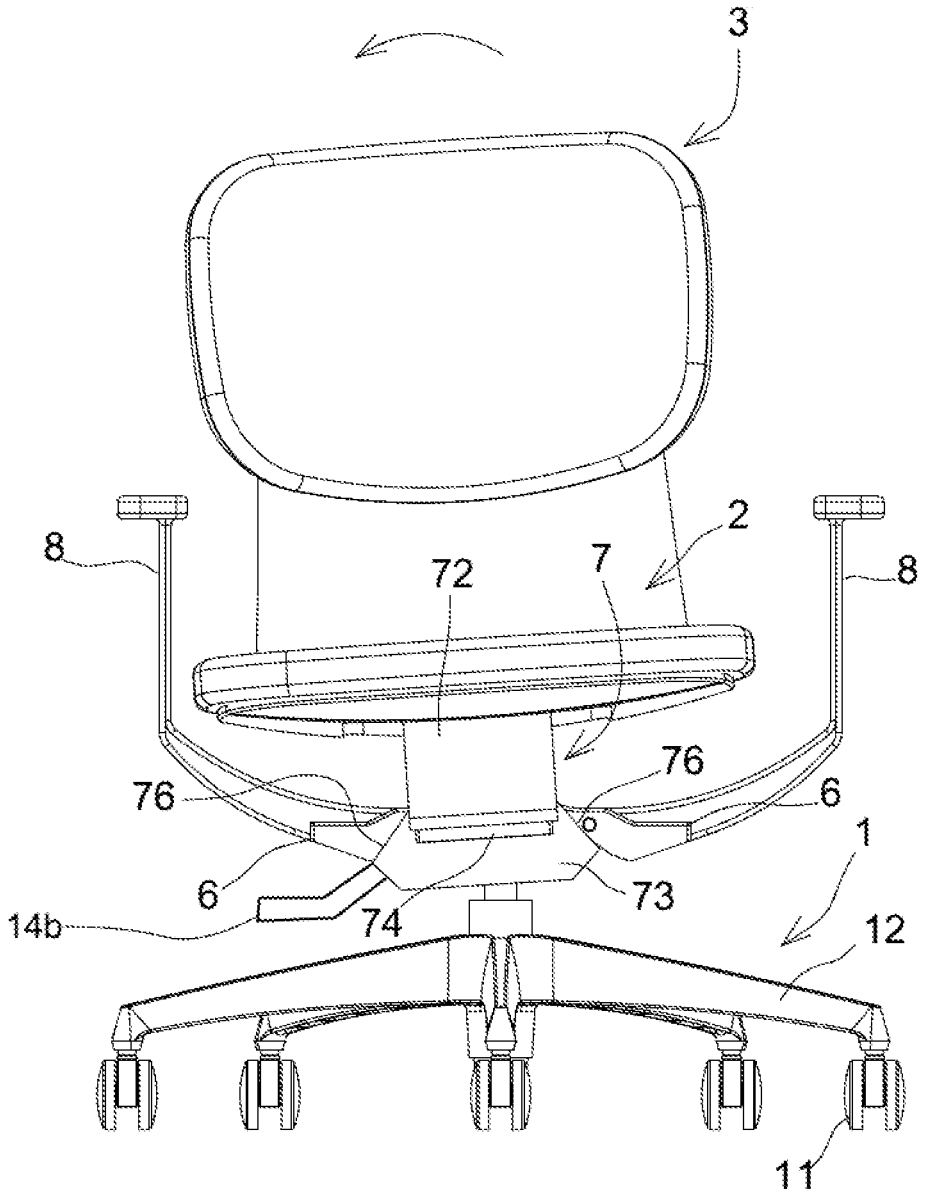
FIG. 18 is an explanatory diagram of movement according to the second embodiment of the present invention.
Figure 19:
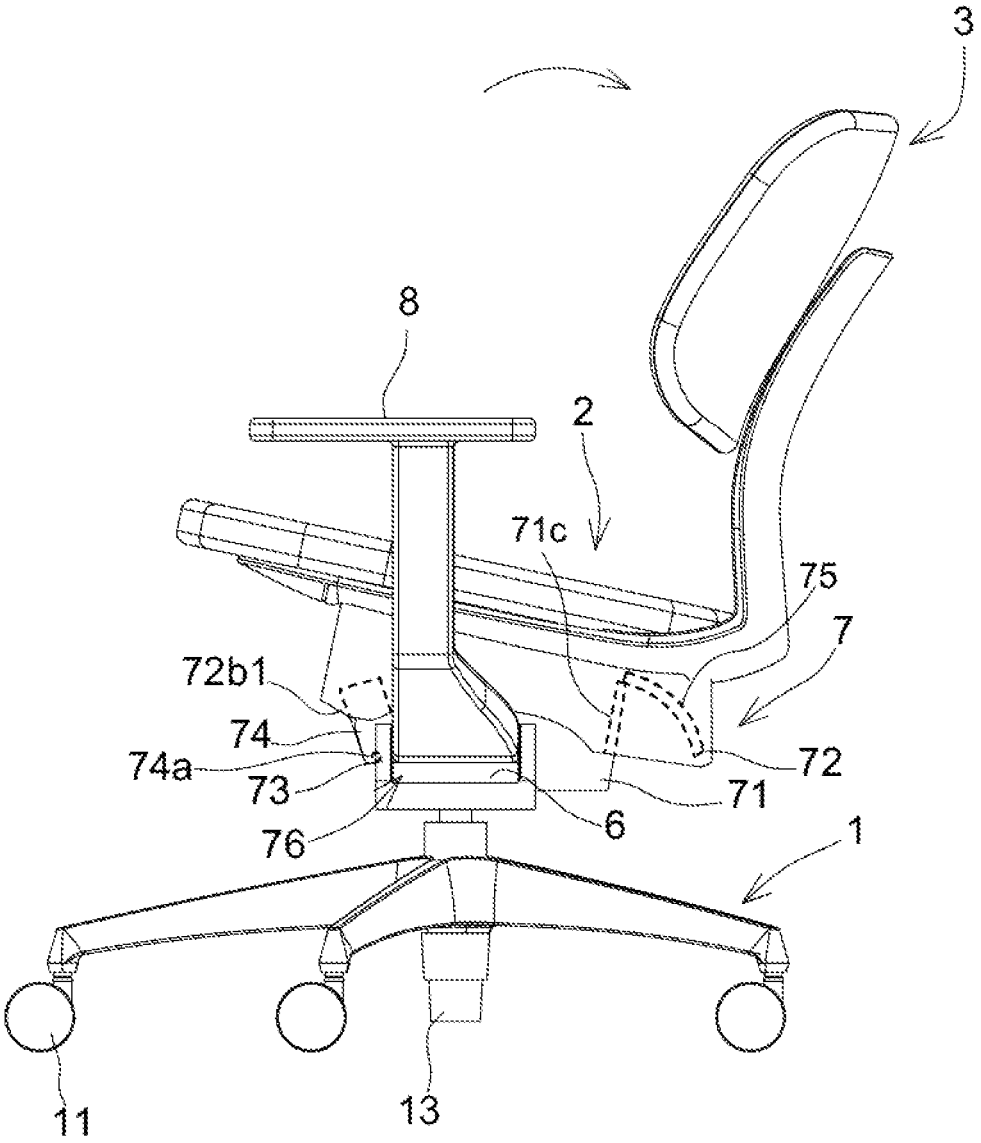
FIG. 19 is an explanatory diagram of movement according to the second embodiment of the present invention.
Figure 20:
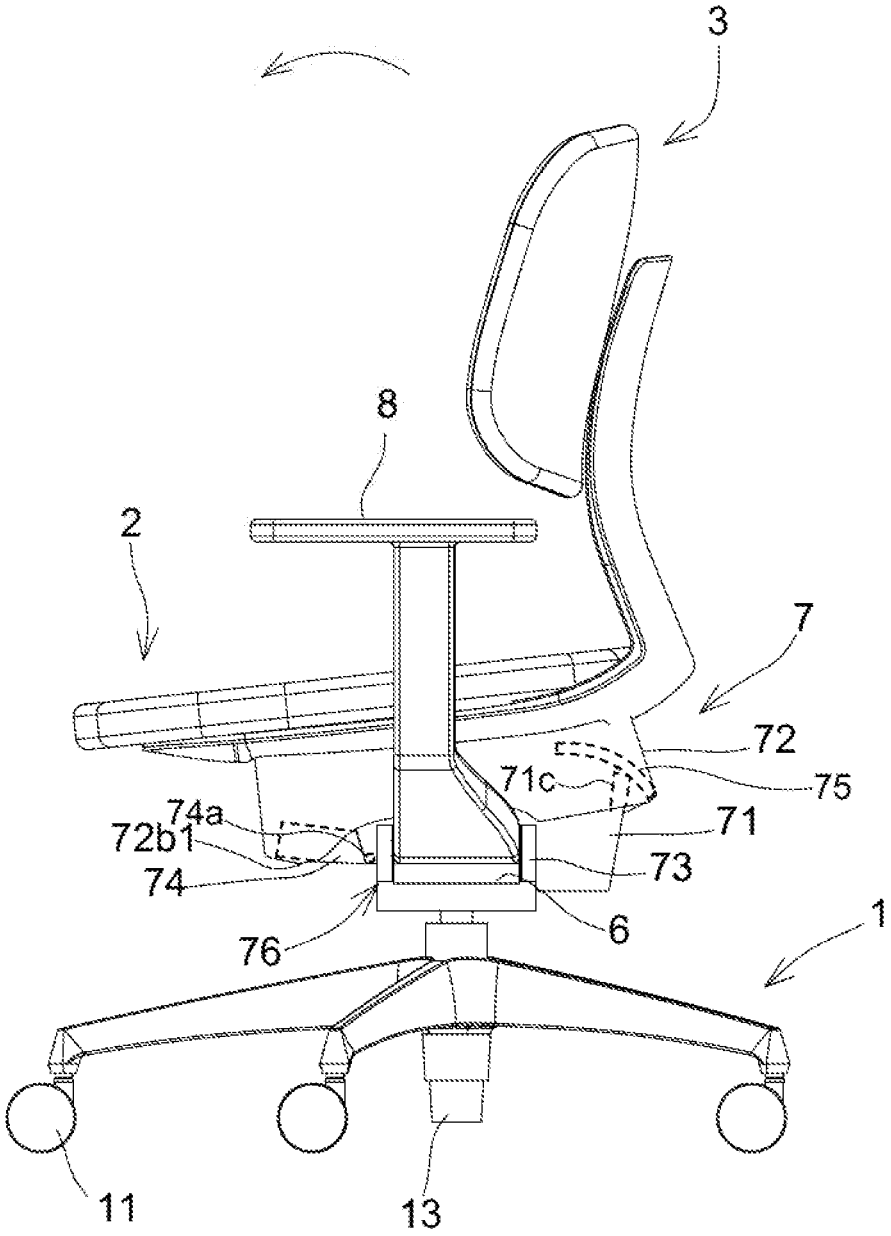
FIG. 20 is an explanatory diagram of movement according to the second embodiment of the present invention.

FIG. 13 is a perspective view of a chair according to the second embodiment. FIG. 14 is a front view of the chair according to the second embodiment. FIG. 15 is a right-side view of the chair according to the second embodiment. FIG. 16 is a lower perspective view of the chair according to the second embodiment. Also, FIG. 17 is an exploded perspective view of the chair according to the second embodiment from which the components located above the seat are removed. FIGS. 18 to 20 are explanatory diagrams of movement of the whole chair.

As illustrated in these drawings, in the same way as in the first embodiment, the chair according to the second embodiment includes the leg 1 provided to stand from a floor surface, the seat 2 and the backrest 3 that are disposed above the leg 1, the leg support pole 13 attached to the leg 1 to support the seat 2 so that the seat 2 moves up and down and can rotate, the support base 4 arranged to the upper end of the leg support pole 13 and configured to horizontally rotate integrally with the leg support pole 13 and not to move in the front-rear direction and the left-right direction in accordance with the movement following of the seat 2, the movement mechanism 5 interposed between the support base 4 and the seat 2 to support the seat 2 so that the seat 2 moves in the front-rear direction and the left-right direction, the arm attachment parts 6 supported by the support base 4, and the movable cover member 7 to cover the movement mechanism 5.

Here, in the second embodiment, a state where the arms 8 are attached to the respective arm attachment parts 6 is illustrated, and the movable cover member 7 having a different shape from that of the foregoing first embodiment is applied. The movable cover member 7 according to the second embodiment is shaped such that in particular, a rear portion is compact compared with the cover member 7 of the first embodiment.

Hereinafter, in the second embodiment, the shape of the movable cover member 7 and the behavior of the movable cover member 7 in accordance with swinging of the chair will be mainly described. It is to be noted that in the second embodiment, the through-holes 71*x*, 72*x* being the through-hole 7*x* formed in the same round hole as one of the first embodiment is formed in any of the cover members 71, 72. However, in the second embodiment, the through-hole 7*x* is not illustrated.

As illustrated in FIG. 17, the movable cover member 7 includes the left-right cover member 71 attached to the left-right support part 51, the front-rear cover member 72 attached to the front-rear support part 52, the interpolation cover member 74 interposed between a front end of the left-right cover member 71 and the front-rear cover member 72, and a back cover member 75 interposed between a rear end of the left-right cover member 71 and the front-rear cover member 72. The back cover member 75 is not provided in the first embodiment. That is, the front-rear cover member 72, the left-right cover member 71, the interpolation cover member 74, and the back cover member 75 are combined, therefore configuring the cover member 7. In addition, in accordance with movements of the plural movement parts 5A, 5B, the cover members 71, 72 move relatively in different directions in a certain area along a predetermined trajectory.

Specifically, in the second embodiment, the left-right cover member 71 includes the pair of right and left standing walls 71*a* each formed in a substantially L-shape. The left-right cover member 71 is attached to the cover attachment member 73. The cover attachment member 73 includes the pair of front and back support plates 73*a* and a connection plate 73*c* connecting between the support plates 73*a*. 73*a*. The support plate 73*a* is swingably attached to the swing ends of the respective link members 51*b* together with the shafts 51*a* as the left-right support portions.

Here, in the second embodiment, arm insertion holes 76*a* allowing insertion of the arm attachment parts 6 are formed in the side of the left-right cover member 71. Specifically, each of the arm insertion holes 76 is a substantially rectangular opening provided between each of the pair of right and left standing walls 71*a* and the connection plate 73*c*. The arm insertion hole 76 is formed to face obliquely upward.

In addition, as illustrated in FIG. 18, in accordance with the left-right swinging of the seat support walls 52*c*, the seat 2 fixed to the seat support walls 52*c* swings in the left-right direction together with the backrest 3. FIG. 18 illustrates an operation in which the seat 2 swings to the left side of FIG. 18. Likewise, obviously, the seat 2 may swing to the right of FIG. 18.

Here, the arms 8 detachably attached to the arm attachment parts 6 provided on the support base 4 do not move in accordance with the swinging of the seat 2. The left-right cover member 71 swings in the left-right direction in accordance with the movement of the left-right support part 51. Since the foregoing arm insertion holes 76 are provided, a large gap is not unnecessarily formed between the left-right cover member 71 and each of the arm attachment parts 6 and the left-right cover member 71 does not make contact with the arm attachment parts 6.

The front-rear cover member 72 is configured such that the right and left standing side walls 72*a*, the front wall 72*b*, and the back wall 72*c* standing on the back side are connected in a frame shape in planar view. The front-rear cover member 72 includes a space inside thereof in which the left-right cover member 71 can be housed. The front-rear cover member 72 is attached to the seat support walls 52*c*, and configured so that while the front-rear cover member 72 swings in the left-right direction and the front-rear direction together with the seat support walls 52*c*, the cam surfaces 52*a* and the cam followers 52*b*, both of which are the front-rear support members, are covered and hidden by the side walls 72*a* and the front wall 72*b*. In addition, as illustrated in FIGS. 16, 19 and 20, the front bottom wall 72*b*1 substantially horizontally disposed is provided at the lower end portion of the front wall 72*b*. The front bottom wall 72*b*1 is consistently contactable with a portion of the interpolation cover member 74.

In the second embodiment, each of the right and left side walls 72*a* is not formed in a reversed L-shape as in the first embodiment and is formed in a substantially rectangular shape. Therefore, a small gap is formed between the back wall 72*c* and the left-right cover member 71.

The interpolation cover member 74 is interposed between the left-right cover member 71 and the front-rear cover member 72. Specifically, as illustrated in FIGS. 16, 19 and 20, the interpolation cover member 74 is rotatably engaged though the shaft 74*a* with the upper end on the front side of the cover attachment member 73, therefore being rotatably attached in the front-rear direction.

In addition, in the second embodiment, the plate-shaped back cover member 75 having a curved shape is attached to a rear end portion of the front-rear cover member 72. The back cover member 75 serves to close the gap formed between the back wall 72*c* and the left-right cover member 71.

The left-right cover member 71 does not swing in the front-rear direction, and the front-rear cover member 72 swings in the front-rear direction. Therefore, gaps are provided between the front wall 72*b* of the front-rear cover member 72 and the front ends of the respective side walls 71*a* of the left-right cover member 71, between the back cover member 75 provided adjacent to the back wall 72*c* of the front-rear cover member 72 and the side walls 71*a* of the left-right cover member 71, and between the back cover member 75 and a rear end of the back wall 71*c* of the left-right cover member 71 such that the relative movement between the left-right cover member 71 and the front-rear cover member 72 does not cause interference therebetween.

Thus, the cover member 7 is configured such that the left-right cover member 71 and the front-rear cover member 72 move relatively close to each other with the gap.

As just described, the cover members 71, 72 moves following in accordance with the movement of the seat 2, and in addition, can cover the support mechanism 5.

Here, as illustrated in FIGS. 19 and 20, the seat 2 is configured to swing in the front-rear direction in the same way as in the first embodiment. For the front-rear movement as just described of the seat 2, in the same way as illustrated in FIG. 7, the front-rear cover member 72 swings in the front-rear direction in accordance with the front-rear swinging of the front-rear support part 52 configuring the support mechanism 5, but the left-right cover member 71 does not swing in the front-rear direction. However, in the second embodiment, the interpolation cover member 74 configured in the same manner as in the first embodiment is provided at the front end side of the left-right cover member 71 and the back cover member 75 is provided at the rear end side of the left-right cover member 71. Therefore, generation of large gaps between the front end portion of the left-right cover member 71 and the front-rear cover member 72 and between the rear end portion of the left-right cover member 71 and the front-rear cover member 72 is effectively avoided.

Furthermore, at the time of the front-rear movement of the seat 2, inside the front-rear cover member 72, the interpolation cover member 74 rotatably attached to a front end of the cover attachment member 73 rotates around the shaft 74*a* with respect to the left-right cover member. In other words, the interpolation cover member 74 rotates around the shaft 74*a* at a base end side with contacting to the front bottom wall 72*b*1 of the front-rear cover member 72 with leaning on the front bottom wall 72*b*1 at a tip end. Thus, generation of a gap between a front end portion of the left-right cover member 71 and the front-rear cover member 72 is effectively avoided.

In particular, in the second embodiment, as indicated by solid lines in FIG. 17 and by dashed lines in FIGS. 19 and 20, the back cover member 75 is fixed to the front-rear cover member 72 to be located therein adjacent to the inside rear end of the front-rear cover member 72. In addition, at the time of the front-rear swinging of the seat 2, the back cover member 75 is configured to allow the seat 2 to swing together with the front-rear cover member 72 with keeping a slight gap between the back cover member 75 and an upper end portion of the back wall 71*c* of the left-right cover member 71.

Consequently, even when the cover members 71, 72 execute a complex movement to each other, foreign objects are prevented from being trapped between the cover members 71, 72 or between the support base 4 and the cover members 71, 72.

As described above, the chair according to the present invention is a chair including the leg 1 arranged on a floor surface, the leg support pole 13 erected from the leg 1, the support base 4 provided at upper end of the leg support pole 13, the seat 2 arranged above the support base 4 and the support mechanism 5 interposed between the support base 4 and the seat 2 and configured to support the seat movably in the front-rear direction and the left-right direction. Further, in the support mechanism 5, the left-right support part 51 is attached to the support base 4 movably in the left-right direction and the front-rear support part 52 is attached to the left-right support part 51 movably the front-rear direction. The seat 2 is attached to the front support part 51 and the support base 4 includes the arm attachment part 6.

In this way, when the support mechanism 5 of the seat 2 is serially combined with the front-rear support part 51 and left-right support part 52, the arm attachment part 6 increases in flexibility of the design. Therefore, it is easily designed to form so that the arm 8 does not circumvent widely to an extreme degree beyond the extent in which an interference with the seat 2 is avoided and an appropriate strength is secured.

In this case, the support base 4 is attached above the leg support pole 13, and from the support base 4, the left-right support portion 51*a* configuring the left-right support part 51 is disposed through the link member 51*b* being a left-right member, and the front-rear support portion 52*c* configuring the front-rear support part 52 is disposed through a cam member and the link member 52*d* being a front-rear member, and the seat 2 is attached to the front-rear support portion 52*c*.

With the configuration, it is possible that the link member 51*b*, the cam surface 52*a* and the cam follower 52*b* being the support member or the link member 52*d*, the left-right support portion 51*a* and the front-rear support portion 52*c* are spatially efficiently arranged and that an appropriate extending condition of the arm attachment part 6 and an appropriate attaching position of the seat 2 are secured.

Further, the support base 4 is attached to the leg support pole 13, the left-right support portion 51*a* is arranged below the support base 4, the front-rear support portion 52*c* is arranged above the support base 4, and the seat 2 is attached to the front-rear support portion 52*c*.

With the configuration, it is possible to specifically realize an efficient spatial arrangement for arranging the seat 2 and the arm attachment part 6.

Further, the arm attachment part 6 extends both laterally from the support base through a space between the left-right support portion 51*a* arranged below the support base 4 and the front-rear support portion 52*c* arranged above the support base 4.

In this way, it is possible to appropriately secure the space for extending the arm attachment part 6.

Further, the arm attachment part 6 is provided with projecting outward beyond the left-right support part 51 and the front-rear support part 52 at the both side ends of the support base 4.

In the second embodiment, the support base 4 is not enlarged in relation to the left-right support part 51 or the front-rear support part 52 and thus, the support base 4 also can be compactly arranged at the upper end of the leg 1. In addition, when the arm attachment part 6 is provided with projecting outward beyond the left-right support part 51 and the front-rear support part 52, it is possible to appropriately secure the attaching position of the arm 8.

Further, the arm 8 is provided detachably at the arm attachment part 6.

With the configuration, it is possible to simplify an attaching operation of the arm 8 and to easily allow an option as a retrofitting structure.

Further, the chair includes the cover member 7 that covers the support mechanism 5 while operating following movement of the seat 2, the cover member 7 is provided below the seat 2 and arranged so as not to interfere with the arm attachment part 6 and the arm 8.

With the configuration, an appearance of the vicinity of the extending position of the arm attachment part 6 can be improved without an interference with movement of the seat 2.

Furthermore, the arm attachment part 6 projects outward beyond the cover member 7.

With the configuration as described above, it is not required to remove the cover when the arm is attached or detached.

Further, the left-right support part 51 has a link member 51*b* that suspends and supports the front-rear support part 52 being a member to be supported and the link member 51*b* is arranged below the support base 4 being a support member.

When the above-described suspension structure by the link member 51 is applied, it is easily secure the space in up-and down direction for extending the arm attachment part 6 within the suspension distance of the link member 51*b*.

Further, the front-rear support part 52 has a cam surface 52*a* disposed at the left-right support part 51 being a support member, and a cam follower 52*b* that is disposed at the front-rear support part 52 and that slides along the cam surface 52*a*.

With the cam structure as described above, a movement in a horizontal direction is mainly performed and thus, it is possible to prevent the space in the up-down direction for extending the arm attachment part 6 from narrowing as much as possible.

Further, the support base 4 is provided rotatably horizontally to the leg 1.

With the configuration, even if the chair is a swivel chair, it is possible to effectively realize a front-rear and left-right swinging movement of the chair with the arm.

Further, the leg support pole 13 includes a lifting up and down mechanism configured to support the support base 4 vertically movably and rotatably, and the lifting up and down mechanism includes the gas spring 14 being the lifting up and down mechanism body that performs an expansion and contraction operation and a lifting up and down lever 14*b* for controlling the expansion and contraction operation, and the lifting up and down lever 14*b* is arranged at the lower surface side of the arm attachment part 6.

With the configuration as described above, it is possible to appropriately extend the lifting up and down lever 14*b* together with the arm attachment part 6 from the support base 4.

It is to be noted that the concrete configuration of each of the components or members is not limited to the above-described embodiments.

In the above-described embodiments, the cam surface 52*a* is provided at the front-rear support part 52 and the cam follower 52*b* is provided at the connection member 53, however, may be reversed.

Further, even when an upper-lower relation of the left-right support part 51 and the front-rear support part 52 is reversed, the present invention can be effectively applied. In this case, the arm attachment part 6 may be attached to the front-rear support part 52. It is the reason that a sense of safety can be maintained even when the arm 8 swings in a front-rear direction.

In addition, even when the other operating part for operating to control the movement of the seat 2, for example, an operating part of a rocking mechanism or a backrest inclining mechanism is provided at the lower face side of the arm attachment part 6, a function effect according to the case the operating part of the lifting up and down mechanism is provided.

Additionally, in the support mechanism 5, it is acceptable that the front-rear part 52 is attached to the support base 4 movably in the front-rear direction, the left-right support part 51 is attached to the front-rear part 52 movably in the left-right direction, and the seat 2 is attached to the front-rear support part 52. In this case, the arm attachment part 6 may be provided at the support base 4 and also may be provided at the front-rear support part 52. In this case, even when the seat 2 moves in the front-rear and left-right directions, the arm moves only in the front-rear direction, but not in the left-right direction. This is the same as movement of the arm of a conventional backrest seat interlocking type swivel chair for office use. A sitting person can hold on with his/her feet in a front direction and is supported by a backrest 3 and thus, even when the arm moves to the front-rear direction, the sitting person does not feel a sense of anxiety.

INDUSTRIAL APPLICABILITY

The present invention is applicable to a chair appropriately used in an office or the like.

DESCRIPTION OF REFERENCE NUMERALS

1: leg
13: leg support pole
2: seat
4: support base
5: support mechanism (movement mechanism)
51: left-right support part
52: front-rear support part
6: arm attachment part

The invention claimed is:

1. A chair comprising:

a leg arranged on a floor surface;

a leg support pole erected from the leg;

a support base provided at an upper end of the leg support pole;

a seat arranged above the support base; and a support mechanism interposed between the support base and the seat and configured to support the seat movably in a front-rear direction and a left-right direction, wherein the support mechanism includes a left-right support part and a front-rear support part, and one of the left-right support part and the front-rear support part is attached to the support base and the seat is attached to the other of the left-right support part and the front-rear support part, the support base is provided so as not to move in the front-rear direction and the left-right direction with respect to the leg support pole, and the support base has an arm attachment part, the arm attachment part being attached to the support base so as not to move in accordance with swinging of the seat.

2. The chair according to claim 1, wherein the one of the left-right support part and the front-rear support part is the left-right support part and the other of the left-right support part and the front-rear support part is the front-rear support part.

3. The chair according to claim 2, wherein the support base is attached above the leg support pole, a left-right support portion which configures the left-right support part is arranged from the support base through a pair of right and left support members, the front-rear support portion which configures the front-rear support part is arranged at the left-right support portion through a pair of front and rear support members, and the seat is attached to the front-rear-support portion.

4. The chair according to claim 2, wherein the support base is attached to the leg support pole, the left-right support part is arranged below the arm attachment part, the front-rear support part is arranged above the arm attachment part, and the seat is attached to the front-rear support portion.

5. The chair according to claim 4, wherein the arm attachment part extends both laterally from the support base through the space between the left-right support portion and the front-rear support portion.

6. The chair according to claim 1, wherein the arm attachment part is projected from both side ends of the support base outward beyond the left-right support part and the front-rear support part.

7. The chair according to claim 6, wherein an arm is provided detachably at the arm attachment part.

8. The chair according to claim 7 comprising a cover member that covers the support mechanism while operating following the movement of the seat, wherein the cover member is provided below the seat and arranged so as not to interfere with the arm attachment part and the arm.

9. The chair according to claim 1, wherein the left-right support part or the front-rear support part has a link member that suspends and supports a member to be supported from a support member.

10. The chair according to claim 1, wherein the left-right support part or the front-rear support part has a cam surface disposed at either a support member or a member to be supported, and a cam follower that is disposed at the other of the support member or the member to be supported and that slides along the cam surface.

11. The chair according to claim 1, wherein the one of the left-right support part and the front-rear support part is the front-rear support part and the other of the left-right support part and the front-rear support part is the left-right support part.

* * * * *